US011662152B2

(12) United States Patent
Sun et al.

(10) Patent No.: US 11,662,152 B2
(45) Date of Patent: May 30, 2023

(54) PLATE HEAT EXCHANGER, HEAT PUMP DEVICE INCLUDING PLATE HEAT EXCHANGER, AND HEAT PUMP COOLING, HEATING, AND HOT WATER SUPPLY SYSTEM INCLUDING HEAT PUMP DEVICE

(71) Applicant: Mitsubishi Electric Corporation, Chiyoda-ku (JP)

(72) Inventors: Faming Sun, Chiyoda-ku (JP); Susumu Yoshimura, Chiyoda-ku (JP); Yoshitaka Eijima, Chiyoda-ku (JP); Sho Shiraishi, Chiyoda-ku (JP); Ryosuke Abe, Chiyoda-ku (JP); Masahiro Yokoi, Chiyoda-ku (JP); Kazutaka Suzuki, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 92 days.

(21) Appl. No.: 16/977,371

(22) PCT Filed: Feb. 28, 2019

(86) PCT No.: PCT/JP2019/007858
§ 371 (c)(1),
(2) Date: Sep. 1, 2020

(87) PCT Pub. No.: WO2019/176566
PCT Pub. Date: Sep. 19, 2019

(65) Prior Publication Data

US 2021/0055057 A1 Feb. 25, 2021

(30) Foreign Application Priority Data

Mar. 15, 2018 (JP) ..... JP2018-047955

(51) Int. Cl.
*F28F 9/00* (2006.01)
*F28D 9/00* (2006.01)
(Continued)

(52) U.S. Cl.
CPC ..... *F28D 9/0093* (2013.01); *F25B 30/02* (2013.01); *F25B 39/04* (2013.01); *F28D 9/005* (2013.01);
(Continued)

(58) Field of Classification Search
CPC ..... F28D 9/0068; F28D 9/0093; F28D 9/005; F28F 2265/18; F28F 1/003; F28F 3/08
See application file for complete search history.

(56) References Cited

U.S. PATENT DOCUMENTS 4,228,848 A * 10/1980 Wadkinson, Jr. ..... F28D 7/106 165/70
5,249,358 A 10/1993 Tousignant et al.
(Continued)

FOREIGN PATENT DOCUMENTS

CN 1550746 * 12/2004 ..... F28F 3/046
CN 1550746 A 12/2004
(Continued)

OTHER PUBLICATIONS

International Search Report dated May 21, 2019 in PCT/JP2019/007858 filed on Feb. 28, 2019, 3 pages.
(Continued)

*Primary Examiner* — Harry E Arant
(74) *Attorney, Agent, or Firm* — Xsensus LLP

(57) ABSTRACT

A plate heat exchanger includes a plurality of heat transfer plates stacked together and each having openings at four corners thereof. The heat transfer plates are partially brazed together such that a first flow passage through which first fluid flows and a second flow passage through which second
(Continued)

fluid flows are alternately arranged with one of the heat transfer plates disposed therebetween, openings at the four corners being connected forming first headers through which the first fluid enters and is discharged and second headers through which the second fluid enters and is discharged. At least one of two heat transfer plates between which the first flow passage or the second flow passage is disposed is formed by a pair of metal plates stacked together. The metal plate adjacent to the second flow passage is thinner than the metal plate adjacent to the first flow passage.

11 Claims, 18 Drawing Sheets

(51) Int. Cl.

| | |
|---|---|
| ***F25B 30/02*** | (2006.01) |
| ***F25B 39/04*** | (2006.01) |
| ***F28F 3/08*** | (2006.01) |
| ***F28F 1/00*** | (2006.01) |
| ***F28F 3/10*** | (2006.01) |
| ***F28F 19/04*** | (2006.01) |

(52) U.S. Cl.
CPC ..... *F28F 1/003* (2013.01); *F28F 3/08* (2013.01); *F28F 3/10* (2013.01); *F28F 19/04* (2013.01); *F25B 2339/047* (2013.01); *F28F 2265/16* (2013.01)

(56) References Cited

U.S. PATENT DOCUMENTS

| | | | |
|---|---|---|---|
| 5,291,945 | A | 3/1994 | Blomgren et al. |
| 2004/0256083 | A1 | 12/2004 | Rehberg et al. |
| 2011/0088882 | A1 | 4/2011 | Persson |
| 2012/0111042 | A1 | 5/2012 | Hamada et al. |
| 2015/0083379 | A1 | 3/2015 | Ito et al. |
| 2016/0040943 | A1 | 2/2016 | Han et al. |
| 2016/0356560 | A1 | 12/2016 | Wei et al. |

FOREIGN PATENT DOCUMENTS

| | | | | |
|---|---|---|---|---|
| CN | 202195728 | U | | 4/2012 |
| CN | 102472540 | A | | 5/2012 |
| CN | 202793110 | U | | 3/2013 |
| CN | 103759474 | A | | 4/2014 |
| CN | 104334994 | A | | 2/2015 |
| DE | 693 24 937 | T2 | | 2/2000 |
| DE | 10 2015 012 029 | A1 | | 3/2017 |
| JP | 5-507787 | A | | 11/1993 |
| JP | 2001-99587 | A | | 4/2001 |
| JP | 2006-183969 | A | | 7/2006 |
| JP | 2010-2123 | A | | 1/2010 |
| JP | 2012-127597 | A | | 7/2012 |
| JP | 2012127597 | | * | 7/2012 |
| JP | 2014-40963 | A | | 3/2014 |
| JP | 2014-66411 | A | | 4/2014 |
| JP | 2016-99093 | A | | 5/2016 |
| KR | 10-2018-0022472 | A | | 3/2018 |
| WO | WO 91/17404 | A1 | | 11/1991 |
| WO | WO 2013/183629 | A1 | | 12/2013 |

OTHER PUBLICATIONS

Office Action dated May 26, 2021 in Chinese Patent Application No. 201980018348.4, 16 pages.
Office Action dated Nov. 4, 2021 in Chinese Patent Application No. 201980018348.4, 17 pages.
Office Action dated Nov. 11, 2021 in German Patent Application No. 11 2019 001 351.3, 15 pages.
Office Action dated Apr. 2, 2022 issued in corresponding CN patent application No. 201980018348.4 (and English translation).
Office Action dated Sep. 5, 2022, in corresponding Chinese patent Application No. 201980018348.4, 13 pages.

* cited by examiner

PLATE HEAT EXCHANGER, HEAT PUMP DEVICE INCLUDING PLATE HEAT EXCHANGER, AND HEAT PUMP COOLING, HEATING, AND HOT WATER SUPPLY SYSTEM INCLUDING HEAT PUMP DEVICE

TECHNICAL FIELD

The present disclosure relates to a plate heat exchanger having a double wall structure, a heat pump device including the plate heat exchanger, and a heat pump cooling, heating, and hot water supply system including the heat pump device.

BACKGROUND ART

A related art plate heat exchanger includes a plurality of heat transfer plates which each have openings at four corners thereof and irregular or corrugated surfaces, the heat transfer plates being stacked together and brazed together at outer wall portions of the heat transfer plates and in regions around the openings so that a first flow passage through which first fluid flows and a second flow passage through which second fluid flows are alternately formed. The openings at the four corners are connected to each other to form first (second) headers through which first (second) fluids flow into and out of the first (second) flow passages. The plate heat exchanger may be configured such that each heat transfer plate has a double wall structure including a pair of metal plates that are brought together (see, for example Patent Literature 1).

The plate heat exchanger according to Patent Literature 1 includes the heat transfer plates which each have a double wall structure. Therefore, even if, for example, corrosion or freezing occurs and cracks are formed in one of the heat transfer plates, penetration between the flow passages does not occur and refrigerant can be prevented from leaking into an indoor space. Also, damage to a device including the plate heat exchanger can be prevented by stopping the device when fluid that has leaked to the outside is detected by a detection sensor.

CITATION LIST

Patent Literature

Patent Literature 1: Japanese Unexamined Patent Application Publication No. 2014-66411

SUMMARY OF INVENTION

Technical Problem

According to the stacking structure of Patent Literature 1, when one of the pair of metal plates that are brought together cracks, fluid that has leaked needs to be discharged to the outside. Therefore, the pair of metal plates are brought into tight contact with each other but are not metal-joined together. Accordingly, an air layer is present between the pair of metal plates, and serves as a thermal resistance that significantly reduces the heat transfer performance. When the pair of metal plates are brought into tight contact with each other to improve the heat transfer performance, the fluid that has leaked cannot be easily discharged to the outside and detected in the outside space.

The present disclosure has been made to solve the above-described problem, and an object thereof is to provide a plate heat exchanger, a heat pump device including the plate heat exchanger, and a heat pump cooling, heating, and hot water supply system including the heat pump device, the plate heat exchanger being configured such that reduction in the heat transfer performance, which is a disadvantage of a double wall structure, can be reduced and such that even if, for example, corrosion or freezing occurs and a crack is formed in a heat transfer plate, fluid can be discharged to the outside without being mixed with the other fluid and the fluid that has leaked can be detected in the outside space.

Solution to Problem

A plate heat exchanger according to an embodiment of the present disclosure includes a plurality of heat transfer plates which each have openings at four corners thereof, the plurality of heat transfer plates being stacked together. The plurality of heat transfer plates are partially brazed together such that a first flow passage through which first fluid flows and a second flow passage through which second fluid flows are alternately arranged with one of the plurality of heat transfer plates disposed therebetween, the openings at the four corners being connected to each other to form first headers through which the first fluid enters and is discharged and second headers through which the second fluid enters and is discharged. At least one of two of the plurality of heat transfer plates between which the first flow passage or the second flow passage is disposed is formed by a pair of metal plates that are stacked together. One of the pair of metal plates that is adjacent to the second flow passage is thinner than the other of the pair of metal plates that is adjacent to the first flow passage.

Advantageous Effects of Invention

The plate heat exchanger according to the embodiment of the present disclosure is configured such that one of the pair of metal plates that is adjacent to the second flow passage is thinner than the other of the pair of metal plates that is adjacent to the first flow passage. When the thickness of the heat transfer plate that is adjacent to the second flow passage is reduced, the efficiency of heat exchange between the first fluid and the second fluid is increased, so that the heat exchange performance of the plate heat exchanger can be improved and that the manufacturing cost can be reduced. In addition, even when, for example, corrosion or freezing occurs, leakage from the metal plate that is adjacent to the second flow passage and thinner than the metal plate that is adjacent to the first flow passage occurs first. Therefore, by detecting leakage of the second fluid with externally installed detection sensors, the fluid can be discharged to the outside without being mixed with the other fluid and the fluid that has leaked can be detected in the outside space.

DESCRIPTION OF EMBODIMENTS

Figure 1:
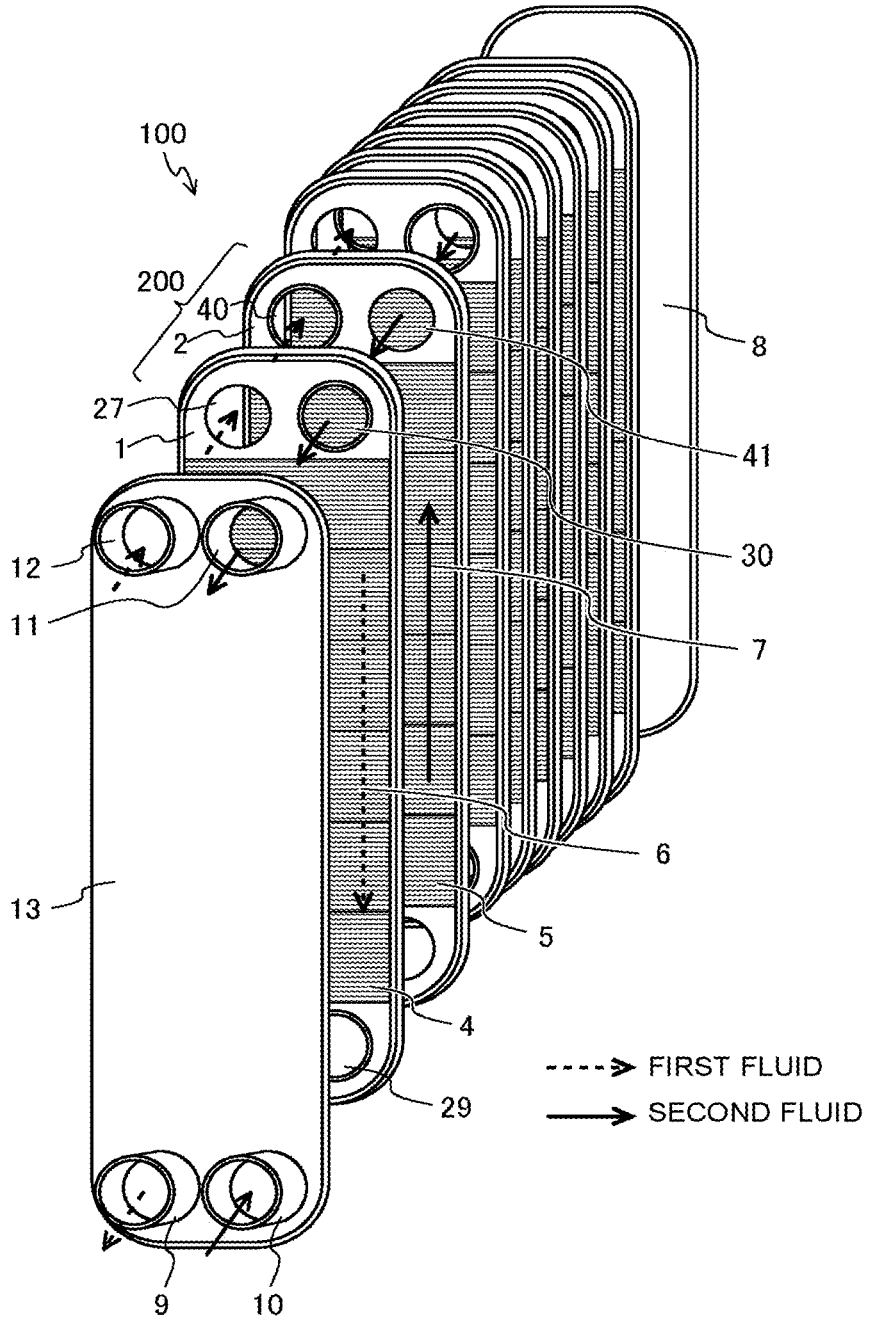
FIG. 1 is an exploded side perspective view of a plate heat exchanger according to Embodiment 1 of the present disclosure.

Embodiments of the present disclosure will now be described with reference to the drawings. The present disclosure is not limited to the embodiments described below. In the drawings, the relationships between the sizes of components may differ from the actual relationships.

Although terms representing directions (for example "up", "down", "right", "left", "front", "rear", etc.) are used as appropriate to facilitate understanding in the following description, these terms are used for the purpose of description, and do not limit the present disclosure. In addition, in the embodiments described below, the terms "up", "down", "right", "left", "front", and "rear" represent directions in front view of a plate heat exchanger 100, that is, directions when the plate heat exchanger 100 is viewed in a stacking direction in which heat transfer plates 1 and 2 are stacked. In addition, with regard to the terms "recess" and "projection", a portion that projects forward is referred to as a "projection", and a portion that projects rearward is referred to as a "recess".

Embodiment 1

Figure 2:
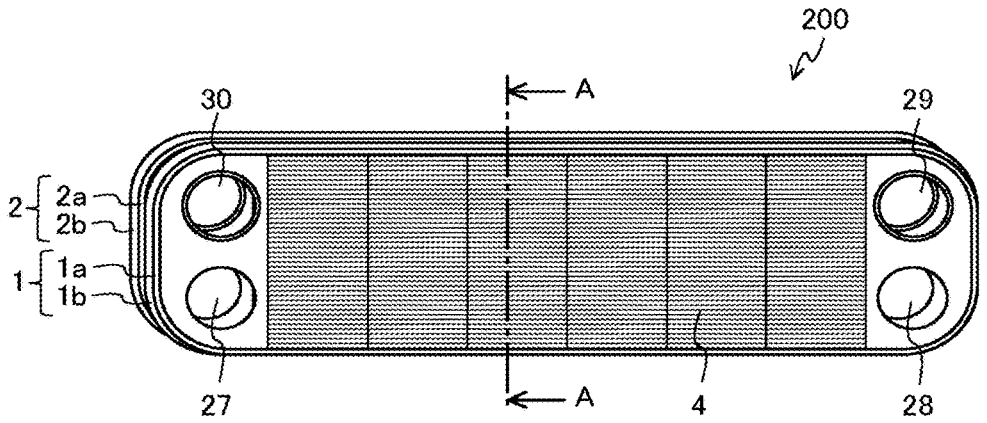
FIG. 2 is a front perspective view of a heat transfer set included in the plate heat exchanger according to Embodiment 1 of the present disclosure.
Figure 3:
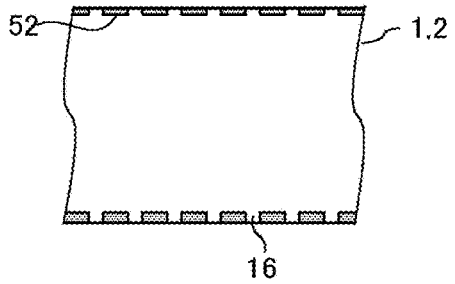
FIG. 3 is a partial schematic diagram illustrating a space between each of pairs of metal plates that form heat transfer plates included in the plate heat exchanger according to Embodiment 1 of the present disclosure.
Figure 4:
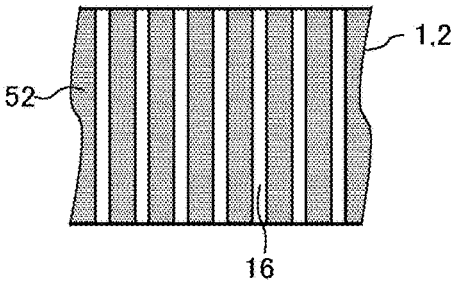
FIG. 4 is a partial schematic diagram illustrating a first modification of the space between each of the pairs of metal plates that form the heat transfer plates included in the plate heat exchanger according to Embodiment 1 of the present disclosure.
Figure 5:
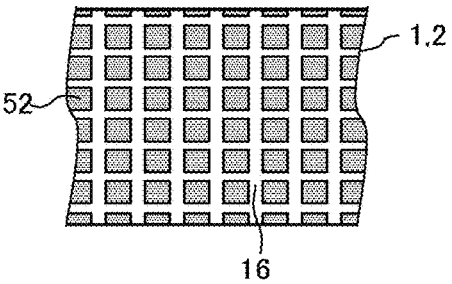
FIG. 5 is a partial schematic diagram illustrating a second modification of the space between each of the pairs of metal plates that form the heat transfer plates included in the plate heat exchanger according to Embodiment 1 of the present disclosure.
Figure 6:
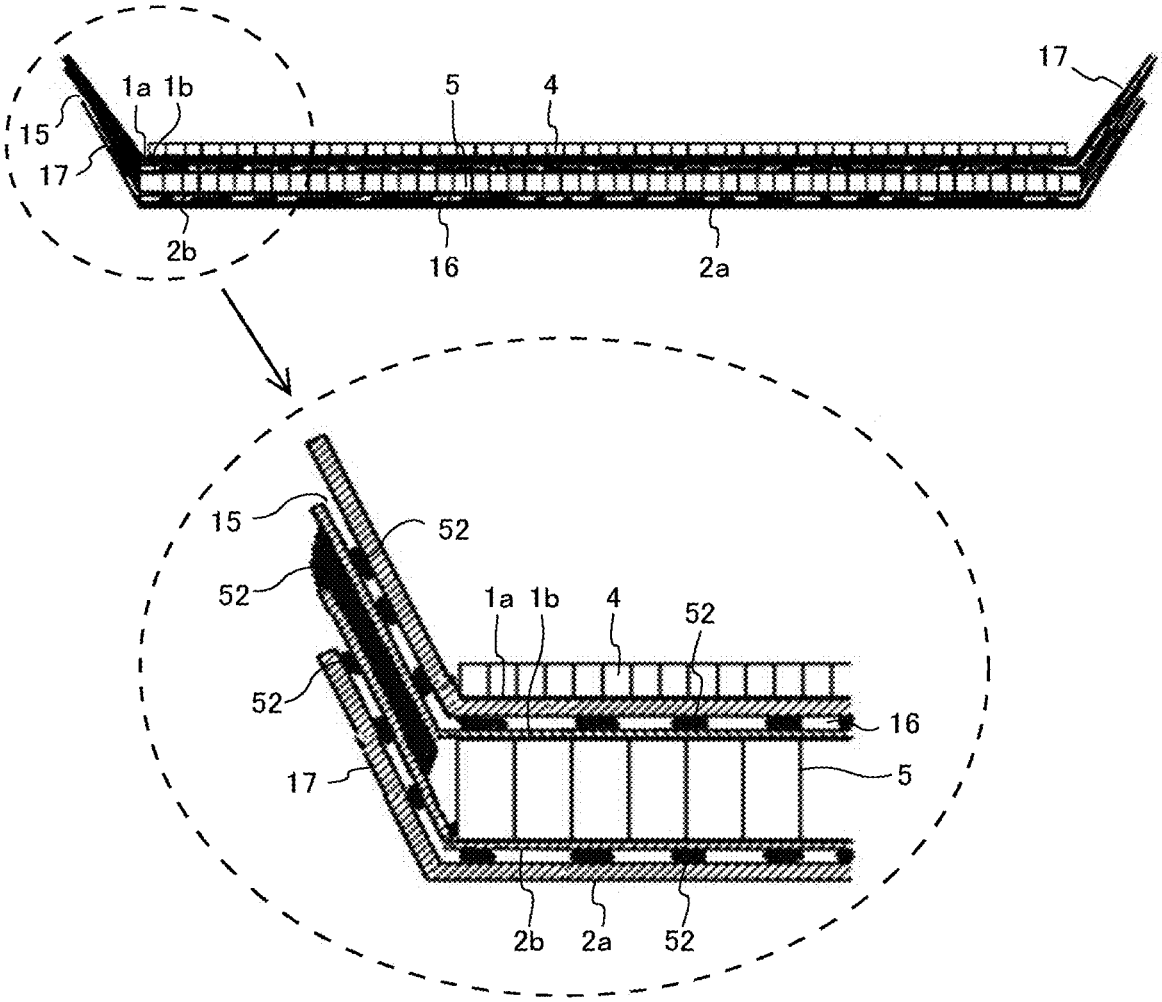
FIG. 6 is a sectional view of the heat transfer set included in the plate heat exchanger according to Embodiment 1 of the present disclosure taken along line A-A in FIG. 2.

FIG. 1 is an exploded side perspective view of the plate heat exchanger 100 according to Embodiment 1 of the present disclosure. FIG. 2 is a front perspective view of a heat transfer set 200 included in the plate heat exchanger 100 according to Embodiment 1 of the present disclosure. FIG. 3 is a partial schematic diagram illustrating a space between each of pairs of metal plates (1*a* and 1*b*), (2*a* and 2*b*) that form the heat transfer plates 1 and 2 included in the plate heat exchanger 100 according to Embodiment 1 of the present disclosure. FIG. 4 is a partial schematic diagram illustrating a first modification of the space between each of the pairs of metal plates (1*a* and 1*b*), (2*a* and 2*b*) that form the heat transfer plates 1 and 2 included in the plate heat exchanger 100 according to Embodiment 1 of the present disclosure. FIG. 5 is a partial schematic diagram illustrating a second modification of the space between each of the pairs of metal plates (1*a* and 1*b*), (2*a* and 2*b*) that form the heat transfer plates 1 and 2 included in the plate heat exchanger 100 according to Embodiment 1 of the present disclosure. FIG. 6 is a sectional view of the heat transfer set 200 included in the plate heat exchanger 100 according to Embodiment 1 of the present disclosure taken along line A-A in FIG. 2.

In FIG. 1, the dotted line arrows show the flow of first fluid, and the solid line arrows show the flow of second fluid. In FIG. 6, the solid black regions show brazed portions 52.

As illustrated in FIG. 1, the plate heat exchanger 100 according to Embodiment 1 includes a plurality of heat transfer plates 1 and 2, which are alternately stacked. As illustrated in FIGS. 1 and 2, the heat transfer plates 1 and 2 have a rectangular shape with round corners and include flat overlapping surfaces. Each of the heat transfer plates 1 and 2 has openings 27 to 30 at four corners thereof. Sets of the heat transfer plates 1 and 2 are referred to as heat transfer sets 200. In Embodiment 1, the heat transfer plates 1 and 2 have an oblong shape with round corners.

As illustrated in FIG. 6, the heat transfer plates 1 and 2 are brazed together at outer wall portions 17, which will be described below, and in regions around the openings 27 to 30. To enable heat exchange between the first fluid and the second fluid, a first flow passage 6 through which the first fluid flows and a second flow passage 7 through which the second fluid flows are alternately arranged with one of the heat transfer plates 1 and 2 being disposed therebetween.

As illustrated in FIGS. 1 and 2, the openings 27 to 30 at the four corners are connected to each other to form first headers 40 through which the first fluid flows into and out of the first flow passages 6 and second headers 41 through which the second fluid flows into and out of the second flow passages 7. To ensure sufficient fluid flow velocities and improve performance, the heat transfer plates 1 and 2 are arranged such that long sides thereof extend in a direction in which the fluids flow and short sides thereof extend in a direction orthogonal thereto.

The first flow passages 6 and the second flow passages 7 are provided with inner fins 4 and 5, respectively. The heat transfer plates 1 and 2 have double wall structures obtained by joining the pairs of metal plates (1*a* and 1*b*), (2*a* and 2*b*) together. The inner fins 4 and 5 are fins disposed between the pairs of metal plates (1*a* and 1*b*), (2*a* and 2*b*).

Referring to FIG. 6, the metal plates 1*a* and 2*a* (hereinafter referred to also as heat transfer plates A) are adjacent to the first flow passages 6 in which the inner fins 4 are provided, and the metal plates 1*b* and 2*b* (hereinafter referred to also as heat transfer plates B) are adjacent to the second flow passages 7 in which the inner fins 5 are provided.

The material of the metal plates 1*a*, 1*b*, 2*a*, and 2*b* may be, for example, stainless steel, carbon steel, aluminum, copper, or an alloy thereof. In the following description, stainless steel is used as the material.

As illustrated in FIG. 1, a first reinforcing side plate 13 having openings at four corners thereof and a second reinforcing side plate 8 are provided on the outermost surfaces of the heat transfer plates 1 and 2 in the stacking direction. The first reinforcing side plate 13 and the second reinforcing side plate 8 have a rectangular shape with round corners and include flat overlapping surfaces. Referring to FIG. 1, the first reinforcing side plate 13 is placed on the foremost surface, and the second reinforcing side plate 8 is placed on the rearmost surface. In Embodiment 1, the first reinforcing side plate 13 and the second reinforcing side plate 8 have a rectangular shape with round corners.

The openings in the first reinforcing side plate 13 are connected to a first inlet pipe 12 through which the first fluid enters, a first outlet pipe 9 through which the first fluid is discharged, a second inlet pipe 10 through which the second fluid enters, and a second outlet pipe 11 through which the second fluid is discharged.

As illustrated in FIG. 6, the heat transfer plates 1 and 2 include the outer wall portions 17 at the edges thereof, the outer wall portions 17 being bent in the stacking direction.

The above-described first fluid is, for example, refrigerant such as R410A, R32, R290, $HFO_{MIX}$, or $CO_2$, and the above-described second fluid is water, an antifreeze such as ethylene glycol or propylene glycol, or a mixture thereof.

The heat transfer plates 1 and 2 are formed by applying an adhesion prevention material (for example, a material that contains a metal oxide as a main component and blocks flow of a brazing material) to the pairs of metal plates (1*a* and 1*b*), (2*a* and 2*b*) in a heat exchange region in which the first fluid and the second fluid exchange heat and placing a brazing sheet (brazing material) made of, for example, copper between each of the pairs of metal plates (1*a* and 1*b*), (2*a* and 2*b*). As illustrated in FIG. 6, the metal plates 1*a*, 1*b*, 2*a*, and 2*b* are joined together by being partially brazed at the brazed portions 52, and fine flow passages 16 are formed between the pairs of metal plates (1*a* and 1*b*), (2*a* and 2*b*) in the heat exchange region.

Outer flow passages 15 that are connected to the outside are formed between the outer wall portions 17 of the pairs of metal plates (1*a* and 1*b*), (2*a* and 2*b*).

The fine flow passages 16 communicate with the outer flow passages 15, which are connected to the outside, so that fluid that has leaked flows through the fine flow passages 16 and is then discharged to the outside through the outer flow passages 15.

As illustrated in FIG. 3, each of the pairs of metal plates (1*a* and 1*b*), (2*a* and 2*b*) may be brought together without adhesion in the heat exchange region so that the fine flow passage 16 is formed over the entirety of the heat exchange region. Alternatively, as illustrated in FIG. 4, each of the pairs of metal plates (1*a* and 1*b*), (2*a* and 2*b*) may be brought together by applying the adhesion prevention material therebetween in a stripe pattern in the heat exchange region and placing the brazing sheet made of, for example, copper therebetween so that a plurality of fine flow passages 16 are formed in a stripe pattern. Alternatively, as illustrated in FIG. 5, each of the pairs of metal plates (1*a* and 1*b*), (2*a* and 2*b*) may be brought together by applying the adhesion prevention material therebetween in a grid pattern in the heat exchange region and placing the brazing sheet made of, for example, copper therebetween so that a plurality of fine flow passages 16 are formed in a grid pattern.

The outer flow passages 15 are formed between the outer wall portions 17 by any one of the above-described methods. The fine flow passages 16 and the outer flow passages 15 may instead be formed in a pattern other than a stripe pattern or a grid pattern.

Although the metal plates 1*a*, 1*b*, 2*a*, and 2*b* and the inner fins 4 and 5 according to Embodiment 1 are made of the same metal material, the materials thereof are not limited to this, and the metal plates 1*a*, 1*b*, 2*a*, and 2*b* and the inner fins 4 and 5 may instead be made of different metals or clad materials.

The metal plates 1*a*, 1*b*, 2*a*, and 2*b* of the heat transfer plates 1 and 2 may be independently designed. For example, the metal plates 1*b* and 2*b* that are adjacent to the second flow passages 7 (hereinafter referred to as heat transfer plates B) may be designed to have a thickness less than that of the metal plates 1*a* and 2*a* that are adjacent to the first flow passages 6 (hereinafter referred to as heat transfer plates A).

The manner in which the fluids flow in the plate heat exchanger 100 according to Embodiment 1 and the effects of the fine flow passages 16 will now be described.

As illustrated in FIG. 1, the first fluid that has entered through the first inlet pipe 12 flows into the first flow passages 6 through the first header 40. The first fluid that has flowed into the first flow passages 6 passes through the spaces between the inner fins 4 and a first outlet header (not shown), and is discharged through the first outlet pipe 9. Similarly, the second fluid flows through the second flow passages 7. The first fluid and the second fluid exchange heat with each other with one of the heat transfer plates 1 and 2 having the double wall structures interposed therebetween.

The inner fins 4, which have a small fin height and are arranged at a small pitch, are provided in the first flow passages 6. Therefore, the heat transfer performance of the first flow passages 6 can be improved as a result of heat transfer enhancement due to reduction in the flow passage diameter and the leading edge effect. Accordingly, the first fluid, which has a lower heat transfer performance than the second fluid, is preferably caused to flow through the first flow passages 6. Thus, the low heat transfer performance of the first fluid can be compensated for and the performance of the plate heat exchanger 100 can be improved.

In addition, since the fine flow passages 16 are formed between the pairs of metal plates (1*a* and 1*b*), (2*a* and 2*b*), even when the heat transfer plates A that are adjacent to the first flow passages 6, in which the pressure is high and corrosion easily occurs, are damaged and leakage of the first fluid that flows through the first flow passages 6 occurs, the first fluid that has leaked flows through the fine flow passages 16 and then is discharged to the outside of the plate heat exchanger 100 through the outer flow passages 15. Then, the leakage of the first fluid can be detected by an externally installed detection sensor. In addition, since the heat transfer plates 1 and 2 have the double wall structures, the first fluid that has leaked does not come into contact with the second fluid, so that the fluids of different types are prevented from being mixed.

The metal plates 1*a*, 1*b*, 2*a*, and 2*b* of the heat transfer plates 1 and 2 are independently designed such that the heat transfer plates A are adjacent to the first flow passages 6, that the heat transfer plates B are adjacent to the second flow passages 7, and that the heat transfer plates B have a thickness less than that of the heat transfer plates A.

In the case where the heat transfer plates B are thinner than the heat transfer plates A, even when the second fluid, such as water, that flows through the second flow passages 7 freezes, leakage from the heat transfer plates B, which are thinner than the heat transfer plates A, occurs first. Therefore, by detecting leakage of the second fluid with externally installed detection sensors, leakage of the first fluid, which is refrigerant such as R410A, R32, R290, $HFO_{MIX}$, or $CO_2$, can be prevented.

In addition, when the thickness of the heat transfer plates B is reduced, the efficiency of heat exchange between the first fluid and the second fluid is increased, so that the heat exchange performance of the plate heat exchanger 100 can be improved and that the manufacturing cost can be reduced.

As described above, the plate heat exchanger 100 includes the plurality of heat transfer plates 1 and 2 which each have the openings 27 to 30 at the four corners thereof, the heat transfer plates 1 and 2 being stacked together. The heat transfer plates 1 and 2 are partially brazed together such that the first flow passage 6 through which the first fluid flows and the second flow passage 7 through which the second fluid flows are alternately arranged with one of the heat transfer plates 1 and 2 disposed therebetween. The openings 27 to 30 at the four corners are connected to each other to form the first headers 40 through which the first fluid enters and is discharged and the second headers 41 through which the second fluid enters and is discharged. At least one of the heat transfer plates 1 and 2 between which the first flow passage 6 or the second flow passage 7 is disposed is formed by a pair of metal plates (1*a* and 1*b*) or (2*a* and 2*b*) that are stacked together. One metal plate 1*b* or 2*b* of the pair of metal plates (1*a* and 1*b*) or (2*a* and 2*b*) that is adjacent to the second flow passage 7 is thinner than the other metal plate 1*a* or 2*a* of the pair of metal plates (1*a* and 1*b*) or (2*a* and 2*b*) that is adjacent to the first flow passage 6.

The plate heat exchanger 100 according to Embodiment 1 is configured such that the metal plates 1*b* and 2*b* that are adjacent to the second flow passages 7 are thinner than the metal plates 1*a* and 2*a* that are adjacent to the first flow passages 6. When the thickness of the metal plates 1*b* and 2*b* that are adjacent to the second flow passages 7 is reduced, the efficiency of heat exchange between the first fluid and the second fluid is increased, so that the heat exchange performance of the plate heat exchanger 100 can be improved and that the manufacturing cost can be reduced. In the case where the metal plates 1*b* and 2*b* are thinner than the metal plates 1*a* and 2*a* as described above, even when the second fluid, such as water, that flows through the second flow passages 7 freezes, leakage from the metal plates 1*b* and 2*b*, which are thinner than the metal plates 1*a* and 2*a*, occurs first. Therefore, by detecting leakage of the second fluid with the externally installed detection sensors, leakage of the first fluid, which is refrigerant such as R410A, R32, R290, $HFO_{MIX}$, or $CO_2$, can be prevented.

Embodiment 2

Embodiment 2 of the present disclosure will now be described. Description given in Embodiment 1 will not be repeated, and components that are the same as or correspond to those in Embodiment 1 are denoted by the same reference signs.

Figure 7:
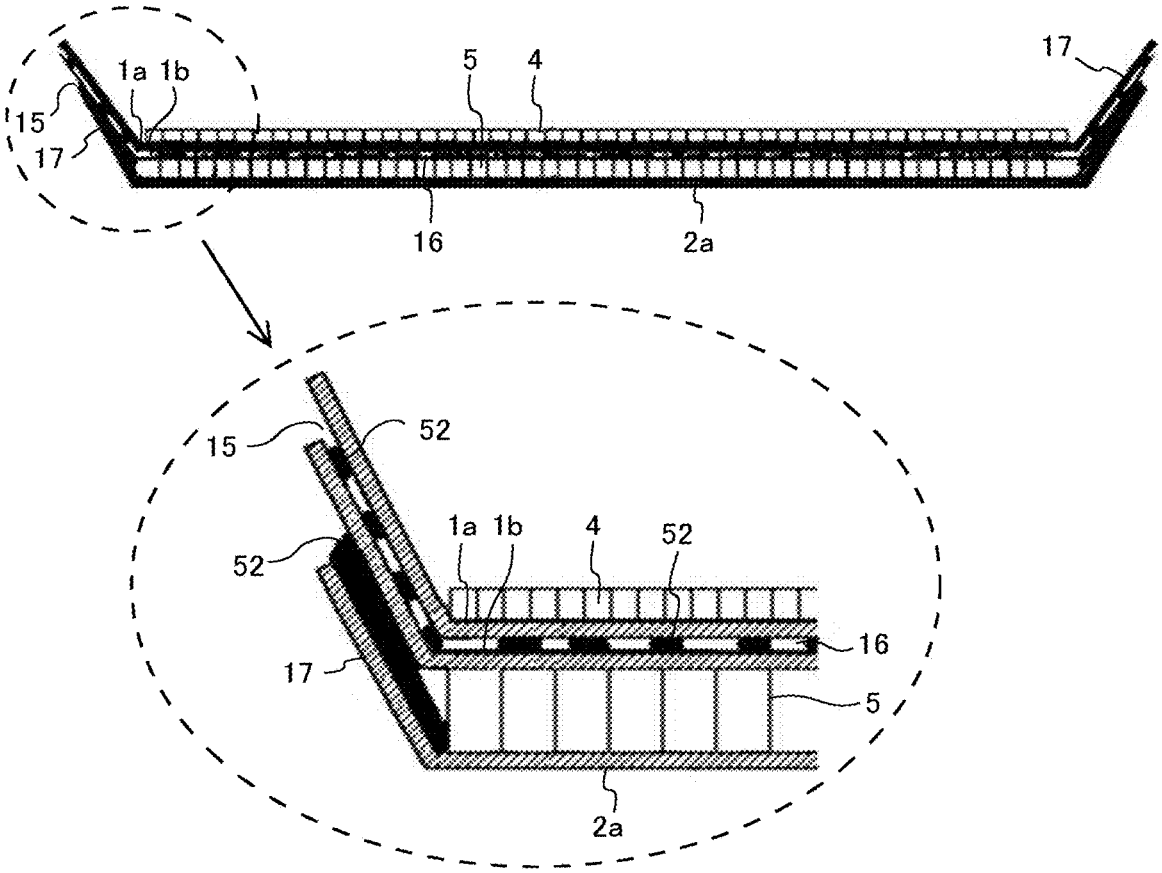
FIG. 7 is a sectional view of a heat transfer set included in a plate heat exchanger according to Embodiment 2 of the present disclosure.
Figure 8:
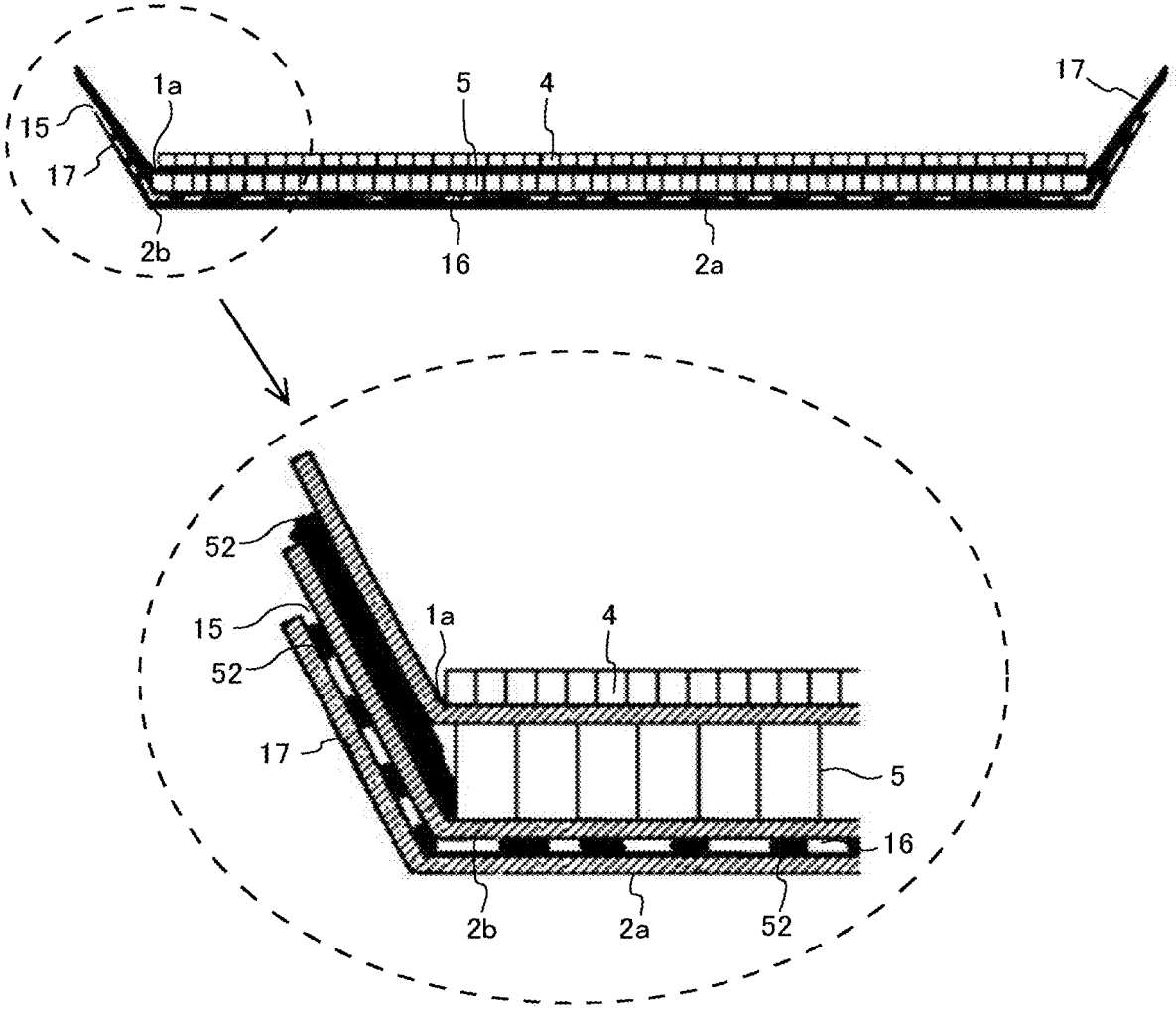
FIG. 8 is a sectional view of a heat transfer set included in a modification of the plate heat exchanger according to Embodiment 2 of the present disclosure.

FIG. 7 is a sectional view of a heat transfer set 200 included in a plate heat exchanger 100 according to Embodiment 2 of the present disclosure. FIG. 8 is a sectional view of a heat transfer set 200 included in a modification of the plate heat exchanger 100 according to Embodiment 2 of the present disclosure. FIGS. 7 and 8 correspond to FIG. 6 in Embodiment 1.

As illustrated in FIG. 7, the plate heat exchanger 100 according to Embodiment 2 is configured such that each heat transfer plate 1 is composed of a pair of metal plates 1*a* and 1*b* and that each heat transfer plate 2 is composed of a single metal plate 2*a*. The metal plates 1*a*, 1*b*, and 2*a* have the same thickness.

A fine flow passage 16 is formed between the pair of metal plates 1*a* and 1*b* in the heat exchange region. An outer flow passage 15, which is connected to the outside, is formed between the outer wall portions 17 of the pair of metal plates 1*a* and 1*b*. The outer flow passage 15 communicates with the fine flow passage 16.

As illustrated in FIG. 8, the plate heat exchanger 100 according to the modification of Embodiment 2 is configured such that each heat transfer plate 2 is composed of a pair of metal plates 2*a* and 2*b* and that each heat transfer plate 1 is composed of a single metal plate 1*a*. The metal plates 1*a*, 1*b*, and 2*a* have the same thickness.

A fine flow passage 16 is formed between the pair of metal plates 2*a* and 2*b* in the heat exchange region. An outer flow passage 15, which is connected to the outside, is formed between the outer wall portions 17 of the pair of metal plates 2*a* and 2*b*. The outer flow passage 15 communicates with the fine flow passage 16.

When one of the heat transfer plates 1 and 2 is composed of a single metal plate 1*a* or 2*a* as described above, the number of processes performed on the metal plates 1*a*, 1*b*, 2*a*, and 2*b* can be reduced, and the manufacturing cost can be reduced accordingly.

Embodiment 3

Embodiment 3 of the present disclosure will now be described. Description given in Embodiments 1 and 2 will not be repeated, and components that are the same as or correspond to those in Embodiments 1 and 2 are denoted by the same reference signs.

Figure 9:
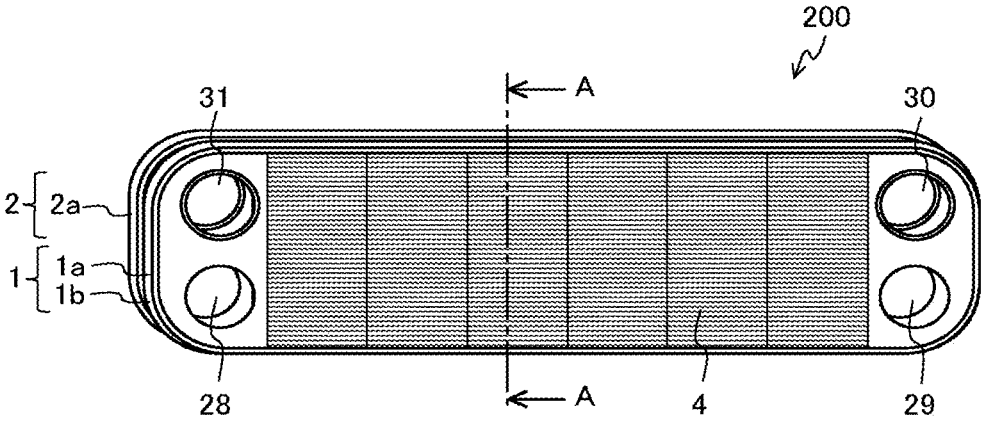
FIG. 9 is a front perspective view of a heat transfer set included in a plate heat exchanger according to Embodiment 3 of the present disclosure.
Figure 10:
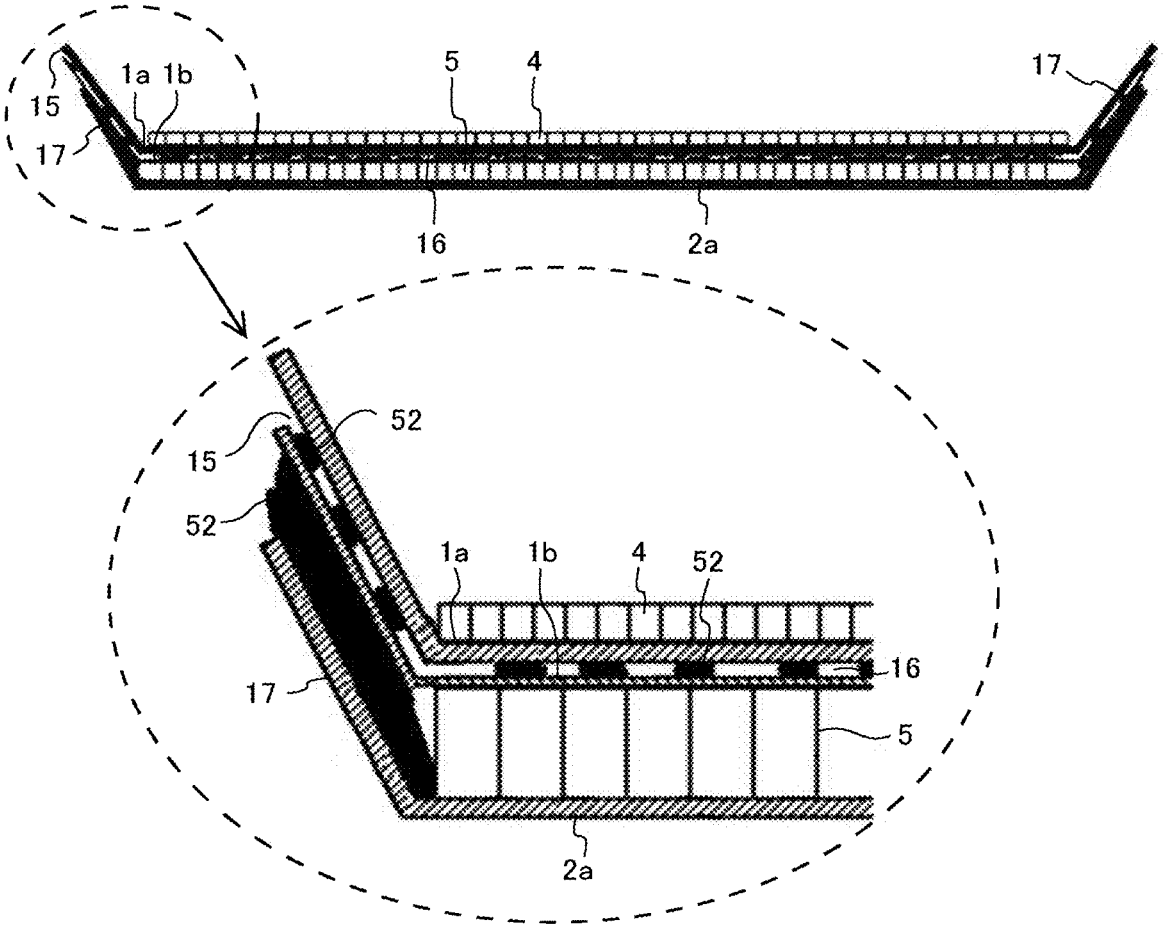
FIG. 10 is a sectional view of the heat transfer set included in the plate heat exchanger according to Embodiment 3 of the present disclosure taken along line A-A in FIG. 9.

FIG. 9 is a front perspective view of a heat transfer set 200 included in a plate heat exchanger 100 according to Embodiment 3 of the present disclosure. FIG. 10 is a sectional view of the heat transfer set 200 included in the plate heat exchanger 100 according to Embodiment 3 of the present disclosure taken along line A-A in FIG. 9.

As illustrated in FIGS. 9 and 10, the plate heat exchanger 100 according to Embodiment 3 is configured such that each heat transfer plate 1 is composed of a pair of metal plates 1*a* and 1*b* and that each heat transfer plate 2 is composed of a single metal plate 2*a*. The metal plates 1*a* and 2*a* have a thickness different from that of the metal plate 1*b*, and the metal plate 1*b* is thinner than the metal plates 1*a* and 2*a*.

A fine flow passage 16 is formed between the pair of metal plates 1*a* and 1*b* in the heat exchange region. An outer flow passage 15, which is connected to the outside, is formed between the outer wall portions 17 of the pair of metal plates 1*a* and 1*b*. The outer flow passage 15 communicates with the fine flow passage 16.

When one of the heat transfer plates 1 and 2 is composed of a single metal plate 1*a* or 2*a* as described above, the number of processes performed on the metal plates 1*a*, 1*b*, 2*a*, and 2*b* can be reduced, and the manufacturing cost can be reduced accordingly.

In the case where the metal plate 1*b* is thinner than the metal plates 1*a* and 2*a* as described above, even when the second fluid, such as water, that flows through the second flow passages 7 freezes, leakage from the metal plate 1*b*, which is thinner than the metal plates 1*a* and 2*a*, occurs first. Therefore, by detecting leakage of the second fluid with the externally installed detection sensors, leakage of the first fluid, which is refrigerant such as R410A, R32, R290, $HFO_{MIX}$, or $CO_2$, can be prevented.

In addition, when the thickness of the metal plates 1*b* and 2*b* is reduced, the efficiency of heat exchange between the first fluid and the second fluid is increased, so that the heat exchange performance of the plate heat exchanger 100 can be improved and that the manufacturing cost can be reduced.

Embodiment 4

Embodiment 4 of the present disclosure will now be described. Description given in Embodiments 1 to 3 will not be repeated, and components that are the same as or correspond to those in Embodiments 1 to 3 are denoted by the same reference signs.

Figure 11:
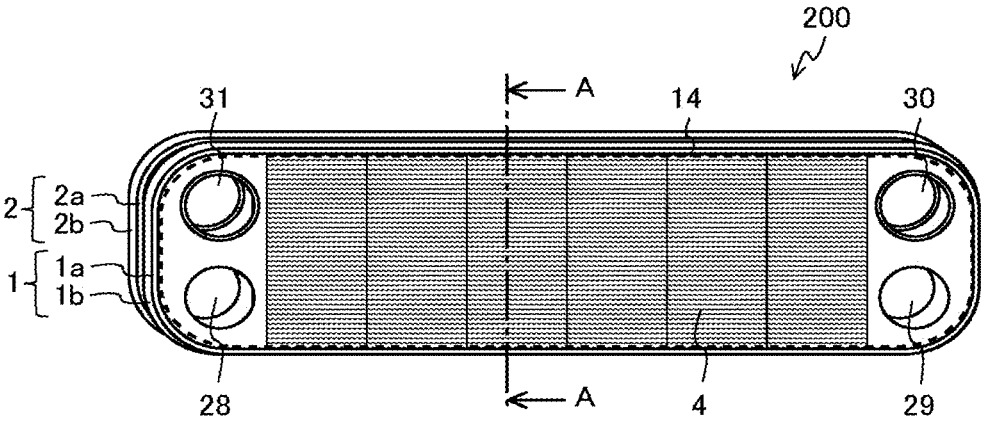
FIG. 11 is a front perspective view of a heat transfer set included in a plate heat exchanger according to Embodiment 4 of the present disclosure.
Figure 12:
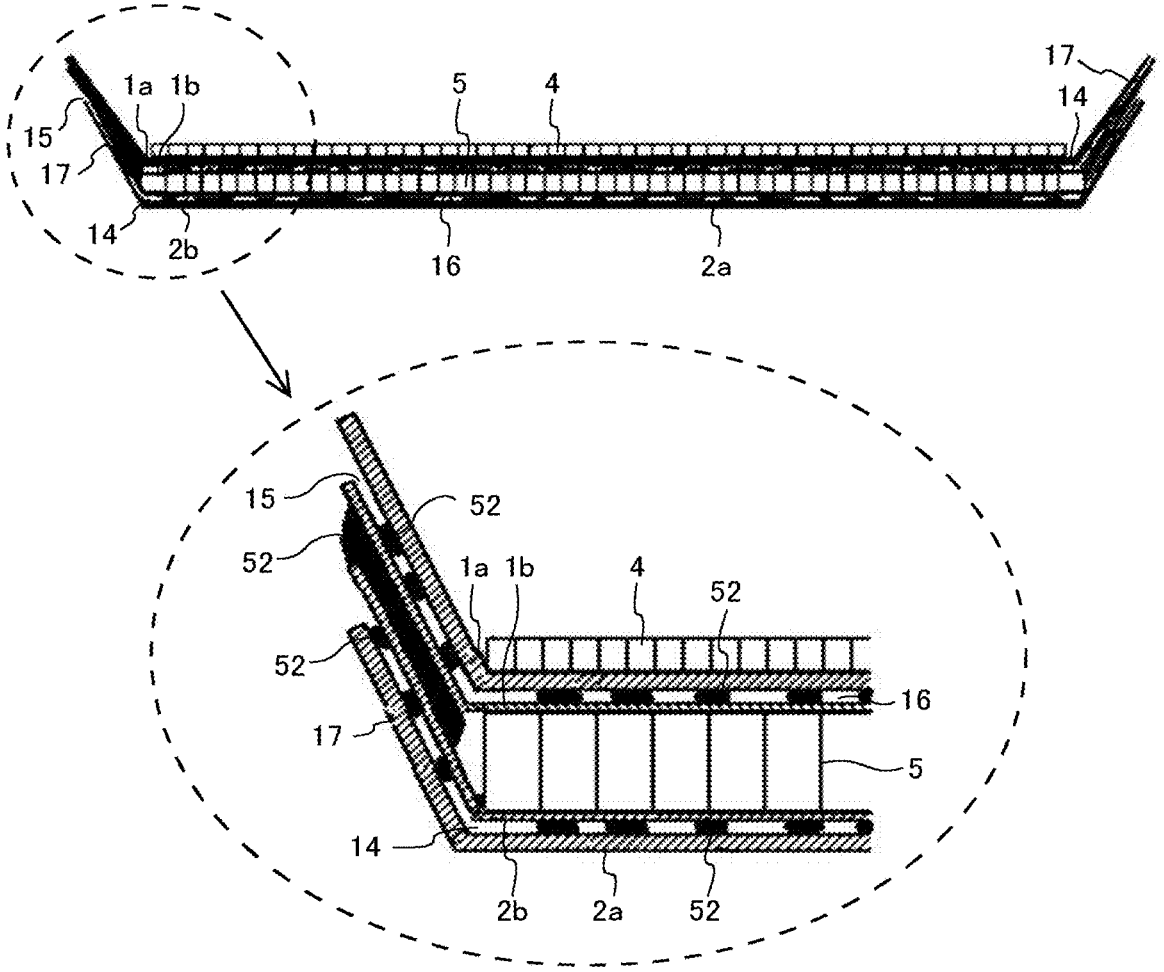
FIG. 12 is a sectional view of the heat transfer set included in the plate heat exchanger according to Embodiment 4 of the present disclosure taken along line A-A in FIG. 11.

FIG. 11 is a front perspective view of a heat transfer set 200 included in a plate heat exchanger 100 according to Embodiment 4 of the present disclosure. FIG. 12 is a sectional view of the heat transfer set 200 included in the plate heat exchanger 100 according to Embodiment 4 of the present disclosure taken along line A-A in FIG. 11.

As illustrated in FIGS. 11 and 12, the plate heat exchanger 100 according to Embodiment 4 is configured such that fine flow passages 16 are formed between the pairs of metal plates (1*a* and 1*b*), (2*a* and 2*b*) in the heat exchange region. In addition, peripheral leakage passages 14 that communicate with the fine flow passages 16 are formed between the pairs of metal plates (1*a* and 1*b*), (2*a* and 2*b*) along the inner ends of the outer wall portions 17. The peripheral leakage passages 14 are disposed in a region inside the outer wall portions 17 and outside the fine flow passages 16, and are formed such that the flow passage width (flow passage cross section) of the peripheral leakage passages 14 is greater than the flow passage width (flow passage cross section) of the fine flow passage 16. The peripheral leakage passages 14 may be formed to extend over the entire perimeter, or be formed to extend discontinuously.

Outer flow passages 15 that are connected to the outside are formed between the outer wall portions 17 of the pairs of metal plates (1*a* and 1*b*), (2*a* and 2*b*). The outer flow passages 15 communicate with the peripheral leakage passages 14.

The fine flow passages 16 and the peripheral leakage passages 14 communicate with the outer flow passages 15, which are connected to the outside, so that fluid that has leaked flows through the fine flow passages 16 and the peripheral leakage passages 14 and is then discharged to the outside through the outer flow passages 15.

In the case where the leakage passages 14 are formed between the metal plates (1*a* and 1*b*), (2*a* and 2*b*) as described above, when leakage of the first fluid occurs, the first fluid flows from the fine flow passages 16 to the peripheral leakage passages 14, where the first fluid that has leaked quickly accumulates. Then, the first fluid is discharged to the outside of the plate heat exchanger 100 through the outer flow passages 15 formed in the region outside the peripheral leakage passages 14. Accordingly, even when some of the outer flow passages 15 that are connected to the outside are clogged, the fluid that has leaked can be caused to accumulate in the leakage passages 14, and then be discharged to the outside through the other outer flow passages 15. In addition, since the fluid that has leaked accumulates in the leakage passages 14, the fluid can be discharged at a flow rate that enables earlier detection of the leakage. In addition, the number of outer flow passages 15 can be reduced, so that the location at which the fluid is discharged to the outside can be easily determined and that detection sensors for detecting the discharged fluid in the outside space can be easily arranged. In addition, the number of detection sensors can be reduced, so that the cost can be reduced.

Embodiment 5

Embodiment 5 of the present disclosure will now be described. Description given in Embodiments 1 to 4 will not be repeated, and components that are the same as or correspond to those in Embodiments 1 to 4 are denoted by the same reference signs.

Figure 13:
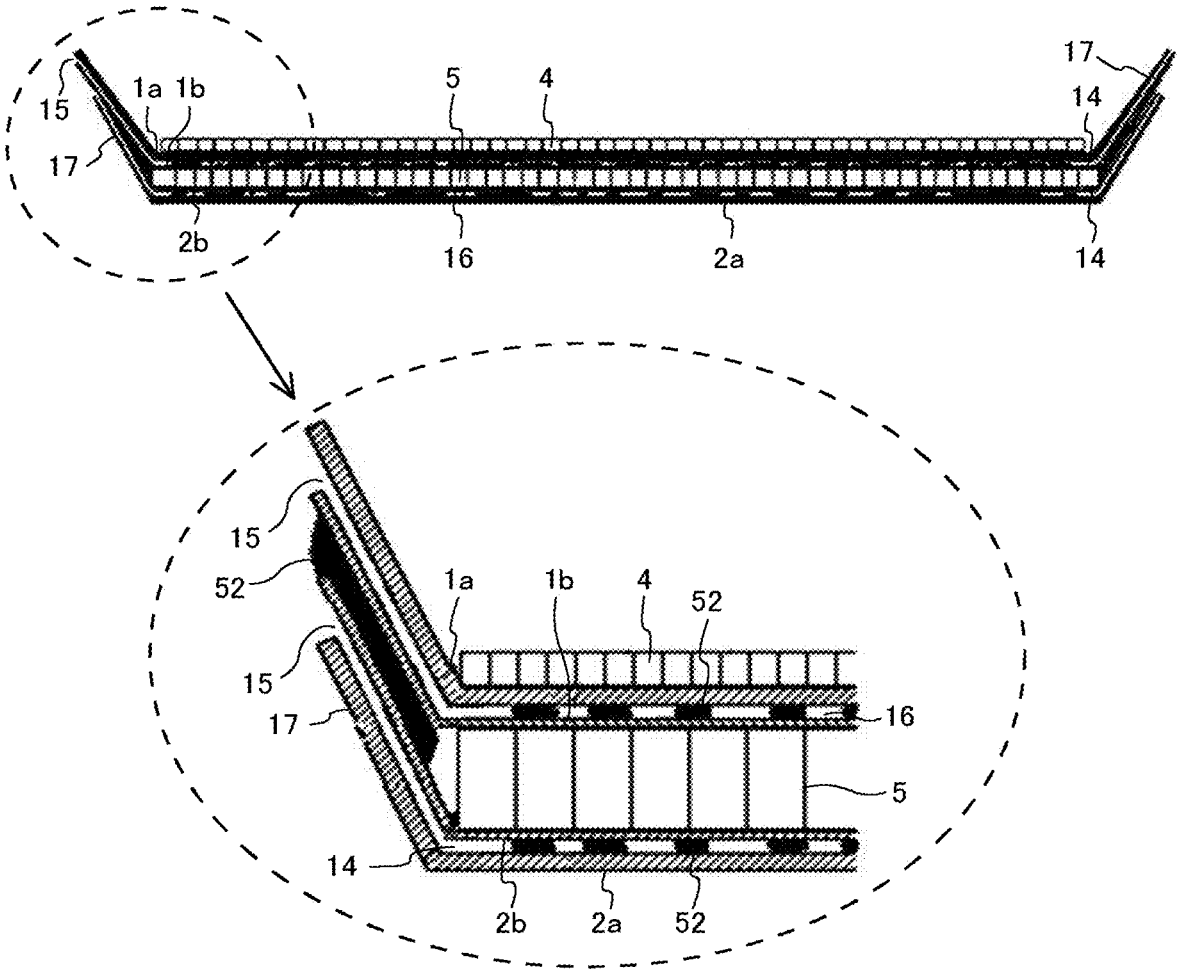
FIG. 13 is a sectional view of a heat transfer set included in a plate heat exchanger according to Embodiment 5 of the present disclosure.

FIG. 13 is a sectional view of a heat transfer set 200 included in a plate heat exchanger 100 according to Embodiment 5 of the present disclosure. FIG. 13 corresponds to FIG. 6 in Embodiment 1.

As illustrated in FIG. 13, the plate heat exchanger 100 according to Embodiment 5 is configured such that the outer wall portions 17 of the pair of metal plates 1*b* and 2*b* are brazed together but the outer wall portions 17 of each of the pairs of metal plates (1*a* and 1*b*), (2*a* and 2*b*) are not brazed together. Therefore, an outer flow passage 15, which is connected to the outside, is formed in the space between the outer wall portions 17 of each of the pairs of metal plates (1*a* and 1*b*), (2*a* and 2*b*) over the entire region thereof.

When the outer flow passage 15 connected to the outside is formed in the space between the outer wall portions 17 of each of the pairs of metal plates (1*a* and 1*b*), (2*a* and 2*b*) over the entire region thereof, the outer flow passage 15 can be prevented from being clogged by the brazing material that are provided between the outer wall portions 17 and that accumulate at the bottom of the outer wall portions 17.

Embodiment 6

Embodiment 6 of the present disclosure will now be described. Description given in Embodiments 1 to 5 will not be repeated, and components that are the same as or correspond to those in Embodiments 1 to 5 are denoted by the same reference signs.

Figure 14:
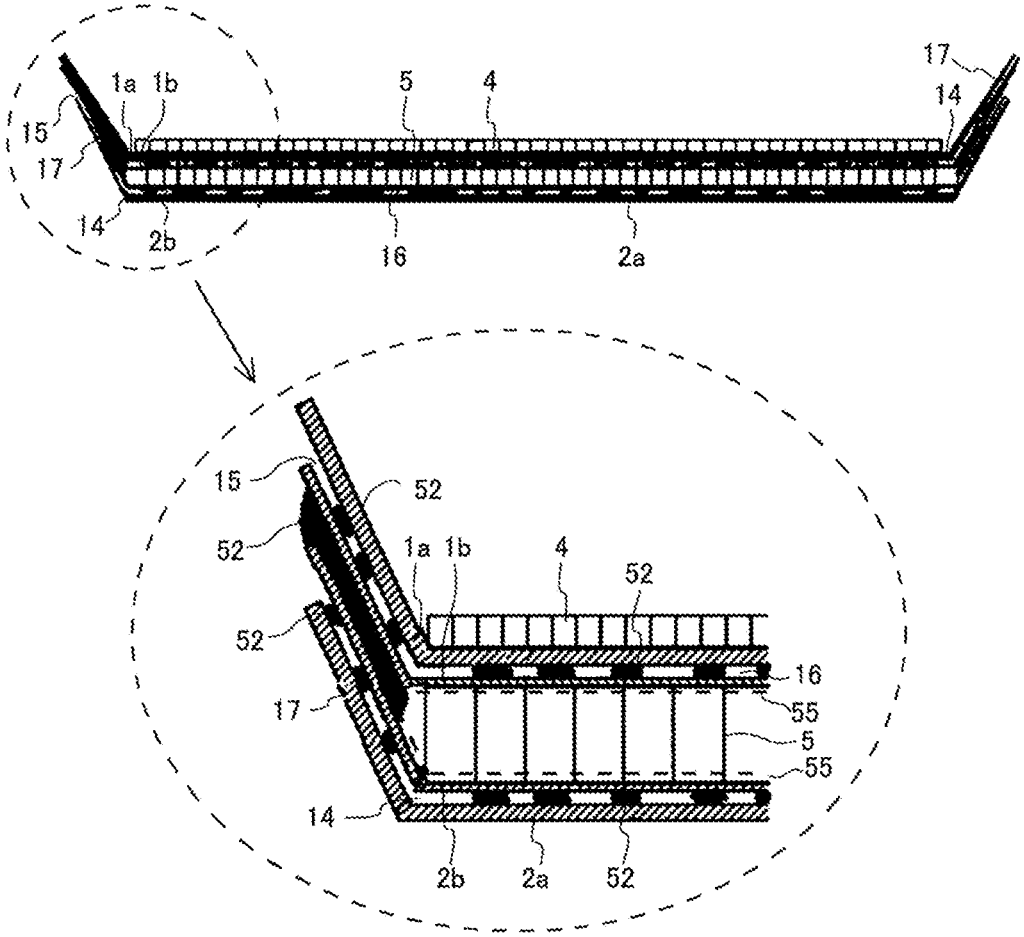
FIG. 14 is a sectional view of a heat transfer set included in a plate heat exchanger according to Embodiment 6 of the present disclosure.

FIG. 14 is a sectional view of a heat transfer set 200 included in a plate heat exchanger 100 according to Embodiment 6 of the present disclosure. FIG. 14 corresponds to FIG. 6 in Embodiment 1.

As illustrated in FIG. 14, the plate heat exchanger 100 according to Embodiment 6 is configured such that the metal plates 1*b* and 2*b* that are adjacent to the second flow passages 7 are provided with corrosion-resistant layers 55. The corrosion-resistant layers 55 are, for example, resin coating layers or glass coating layers.

When the metal plates 1*b* and 2*b* that are adjacent to the second flow passages 7 are provided with the corrosion-resistant layers 55, foreign metal, such as the brazing material, does not enter the heat transfer plates 1 and 2, so that falling of the foreign metal that has entered the heat transfer plates 1 and 2 due to the influence of the second fluid that flows through the second flow passages 7 can be prevented. The thickness of the corrosion-resistant layers 55 is preferably as small as possible within a range such that entrance of the second fluid can be prevented, and is preferably less than or equal to, for example, 50 μm.

When the metal plates 1*b* and 2*b* that are adjacent to the second flow passages 7 are provided with the corrosion-resistant layers 55 as described above, falling of the foreign metal that has entered the heat transfer plates 1 and 2 can be prevented. In addition, the thickness of the metal plates 1*b* and 2*b* that are adjacent to the second flow passages 7 can be designed to have a smaller thickness, so that the efficiency of heat exchange between the first fluid and the second fluid is increased. Accordingly, the heat exchange performance of the plate heat exchanger 100 can be improved, and the manufacturing cost can be reduced.

Embodiment 7

Embodiment 7 of the present disclosure will now be described. Description given in Embodiments 1 to 6 will not be repeated, and components that are the same as or correspond to those in Embodiments 1 to 6 are denoted by the same reference signs.

Figure 15:
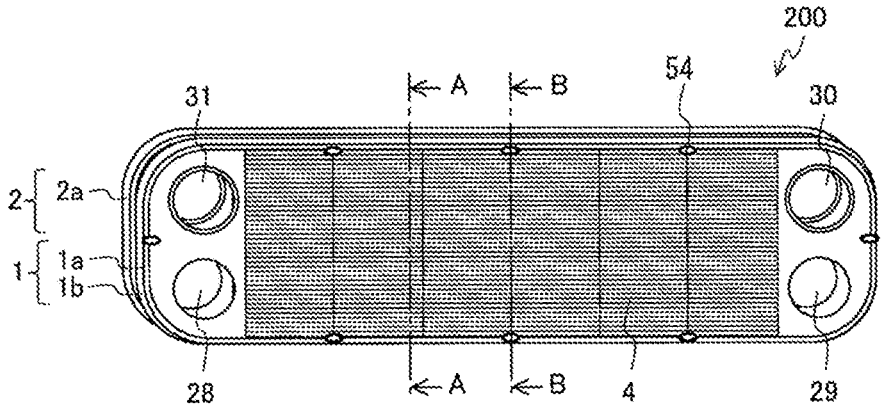
FIG. 15 is a front perspective view of a heat transfer set included in a plate heat exchanger according to Embodiment 7 of the present disclosure.
Figure 16:
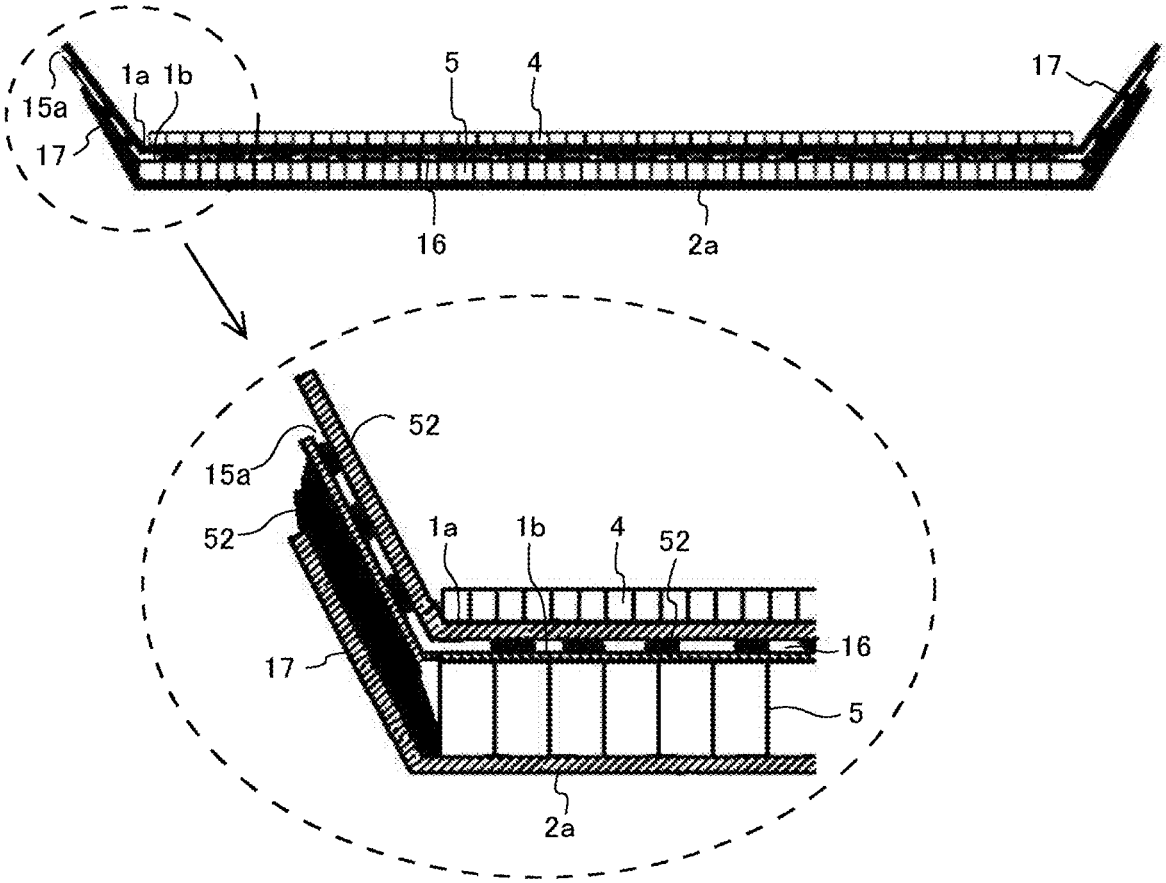
FIG. 16 is a sectional view of the heat transfer set included in the plate heat exchanger according to Embodiment 7 of the present disclosure taken along line A-A in FIG. 15.
Figure 17:
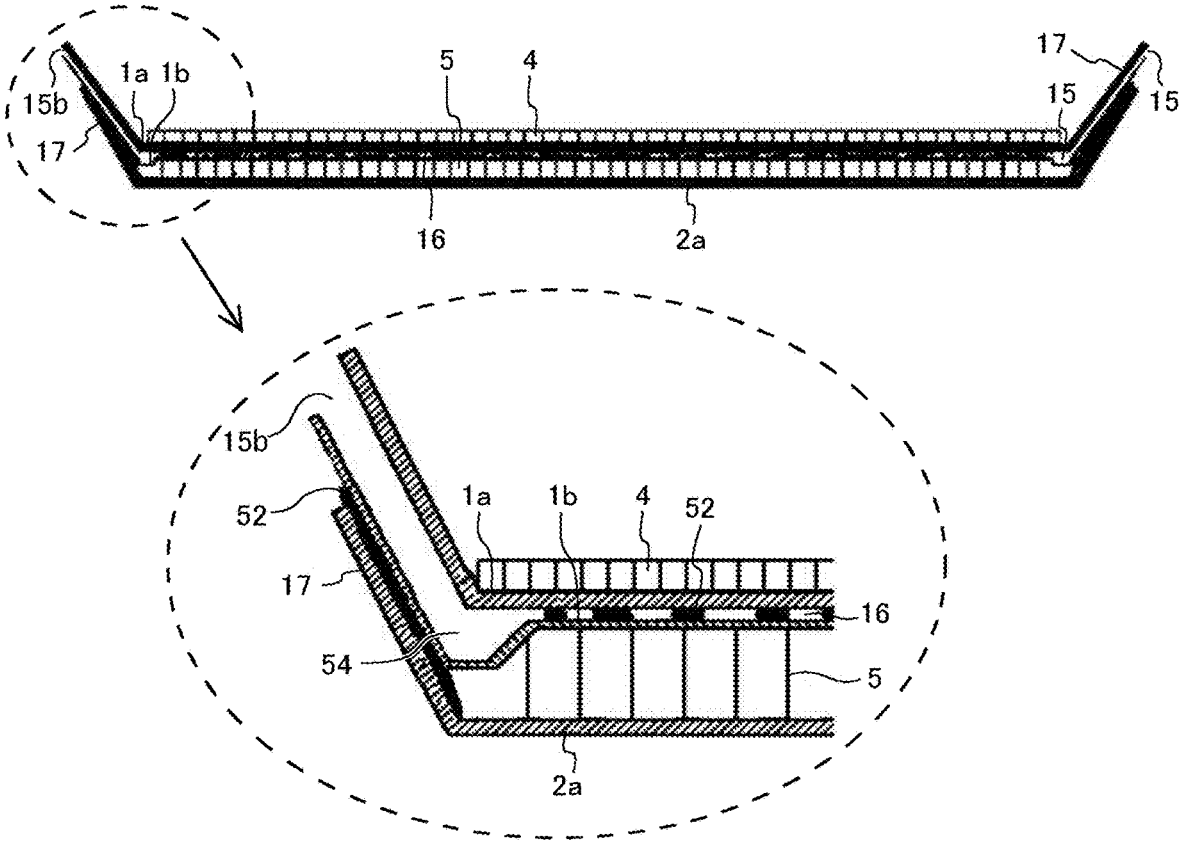
FIG. 17 is a sectional view of the heat transfer set included in the plate heat exchanger according to Embodiment 7 of the present disclosure taken along line B-B in FIG. 15.

FIG. 15 is a front perspective view of a heat transfer set 200 included in a plate heat exchanger 100 according to Embodiment 7 of the present disclosure. FIG. 16 is a sectional view of the heat transfer set 200 included in the plate heat exchanger 100 according to Embodiment 7 of the present disclosure taken along line A-A in FIG. 15. FIG. 17 is a sectional view of the heat transfer set 200 included in the plate heat exchanger 100 according to Embodiment 7 of the present disclosure taken along line B-B in FIG. 15.

As illustrated in FIGS. 15 to 17, the plate heat exchanger 100 according to Embodiment 7 is configured such that each heat transfer plate 1 is composed of a pair of metal plates 1*a* and 1*b* and that each heat transfer plate 2 is composed of a single metal plate 2*a*. The metal plates 1*a* and 2*a* have a thickness different from that of the metal plate 1*b*, and the metal plate 1*b* is thinner than the metal plates 1*a* and 2*a*.

As illustrated in FIG. 17, the metal plate 1*b* has projections that project toward the second flow passage 7 in portions of a region inside the outer wall portions 17 and outside the fine flow passage 16. As illustrated in FIG. 16, the metal plate 1*b* has no projection that projects toward the second flow passage 7 in other portions of the region inside the outer wall portions 17 and outside the fine flow passage 16. The metal plate 1*a* has no projection in the region inside the outer wall portions 17 and outside the fine flow passage 16.

Thus, as illustrated in FIGS. 15 and 17, wet spots 54 are formed between the metal plates 1*a* and 1*b* by forming projections only on portions of the metal plate 1*b*. In addition, the outer flow passages 15*a* and 15*b* are formed between the outer wall portions 17 of the pair of metal plates 1*a* and 1*b*. The outer flow passages 15*a* are not connected to the outside, and the outer flow passages 15*b* are connected to the outside. Thus, only some of the outer flow passages 15*a* and 15*b* are connected to the outside.

As described above, the metal plate 1*b* is thinner than the metal plates 1*a* and 2*a*, and the wet spots 54 are formed on the metal plate 1*b* in portions of the region inside the outer wall portions 17 and outside the fine flow passage 16. Since the portions of the metal plate 1*b* on which the wet spots 54 are formed has a small thickness and projections are formed thereon, these portions have a lower strength than the other portions. Therefore, even when the second fluid, such as water, that flows through the second flow passage 7 freezes, the portions of the metal plate 1*b* on which the wet spots 54 are formed break first, and leakage therefrom occurs first. As a result, by detecting leakage of the second fluid with the externally installed detection sensors, leakage of the first fluid, which is refrigerant such as R410A, R32, R290, $HFO_{MIX}$, or $CO_2$, can be prevented.

Embodiment 8

Embodiment 8 of the present disclosure will now be described. Description given in Embodiments 1 to 7 will not be repeated, and components that are the same as or correspond to those in Embodiments 1 to 7 are denoted by the same reference signs.

Figure 18:
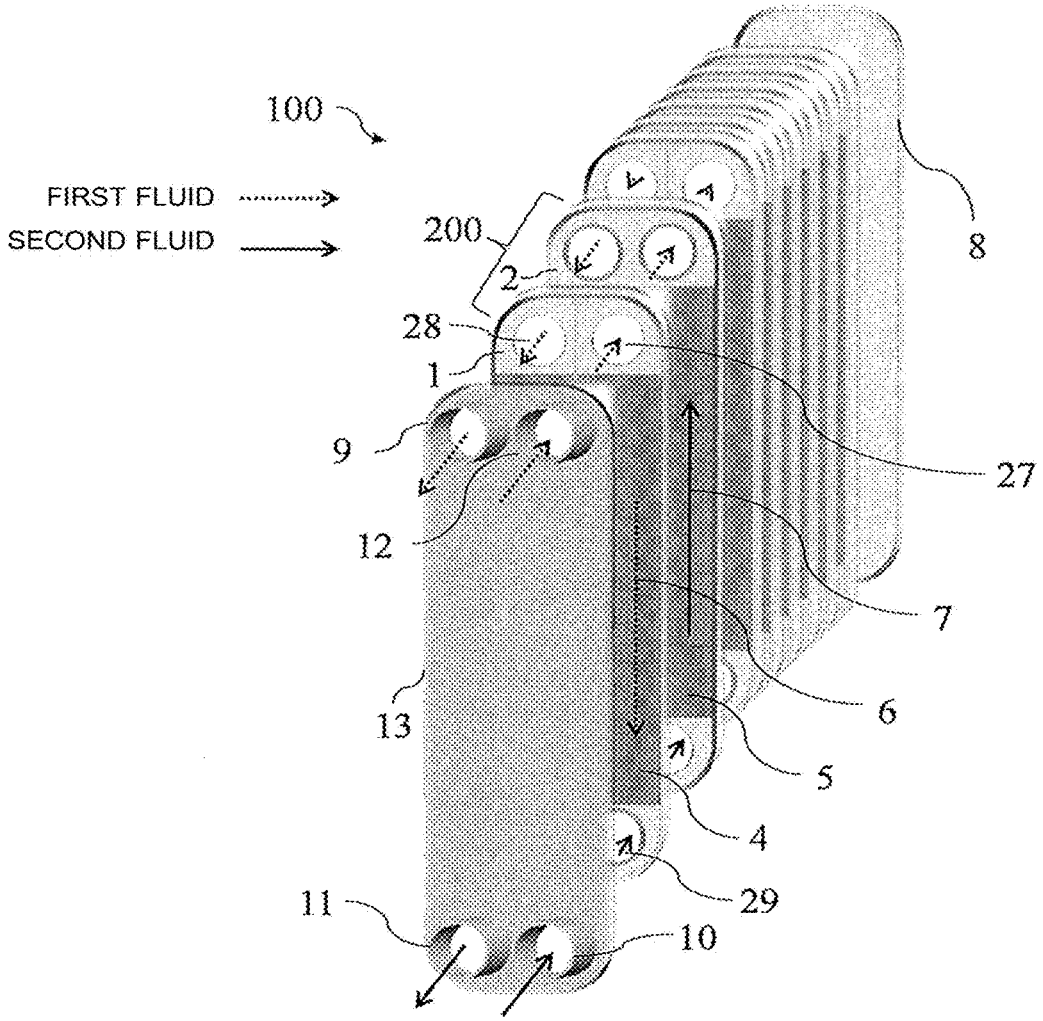
FIG. 18 is an exploded side perspective view of a plate heat exchanger according to Embodiment 8 of the present disclosure.
Figure 19:
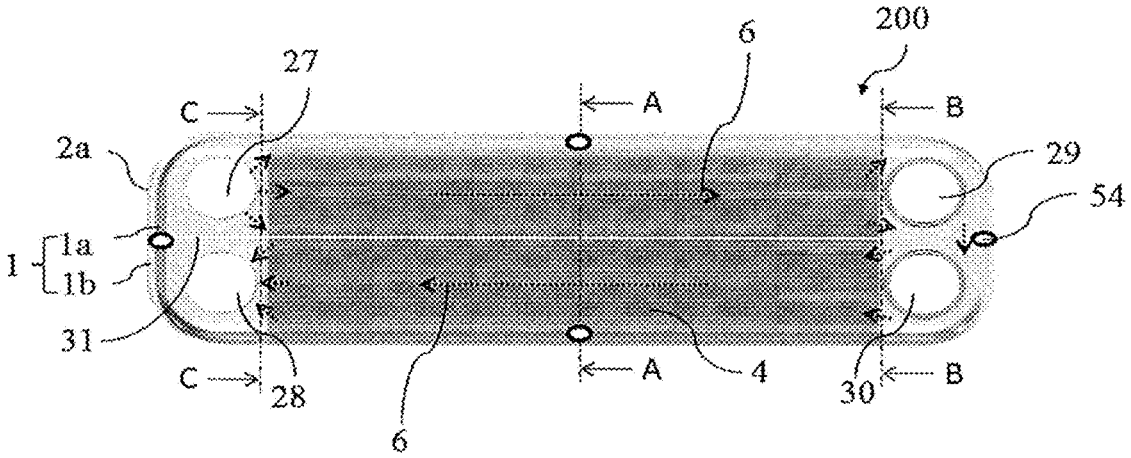
FIG. 19 is a front perspective view of a heat transfer set included in the plate heat exchanger according to Embodiment 8 of the present disclosure.
Figure 20:
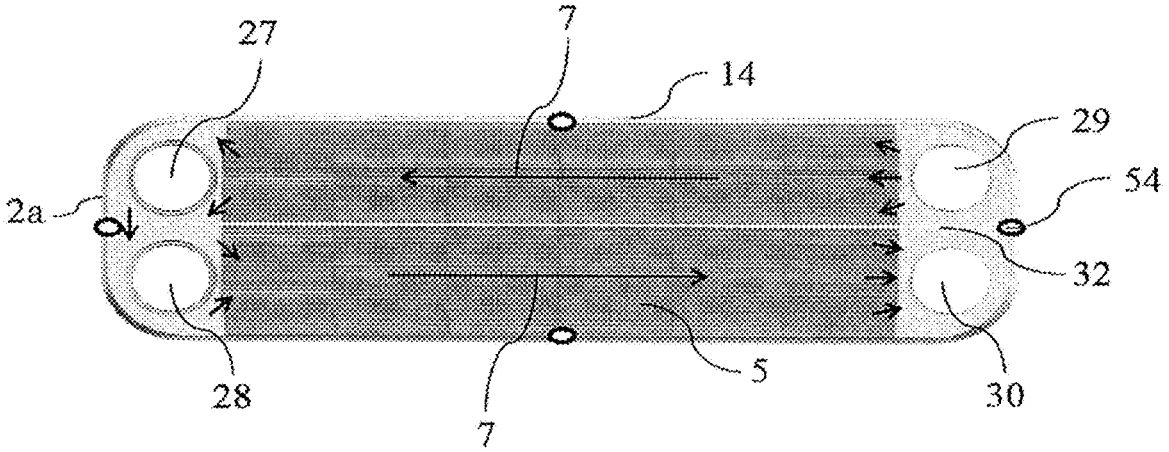
FIG. 20 is a front perspective view of a heat transfer plate included in the plate heat exchanger according to Embodiment 8 of the present disclosure.
Figure 21:
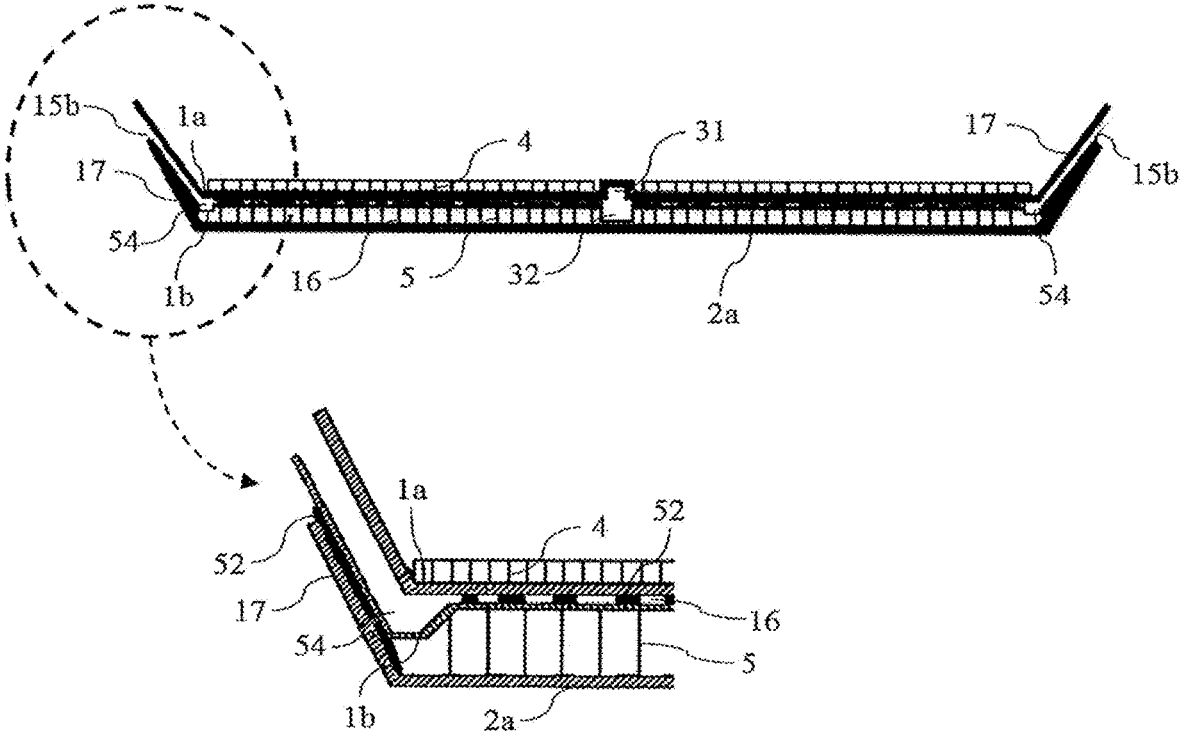
FIG. 21 is a sectional view of the heat transfer set included in the plate heat exchanger according to Embodiment 8 of the present disclosure taken along line A-A in FIG. 19.
Figure 22:
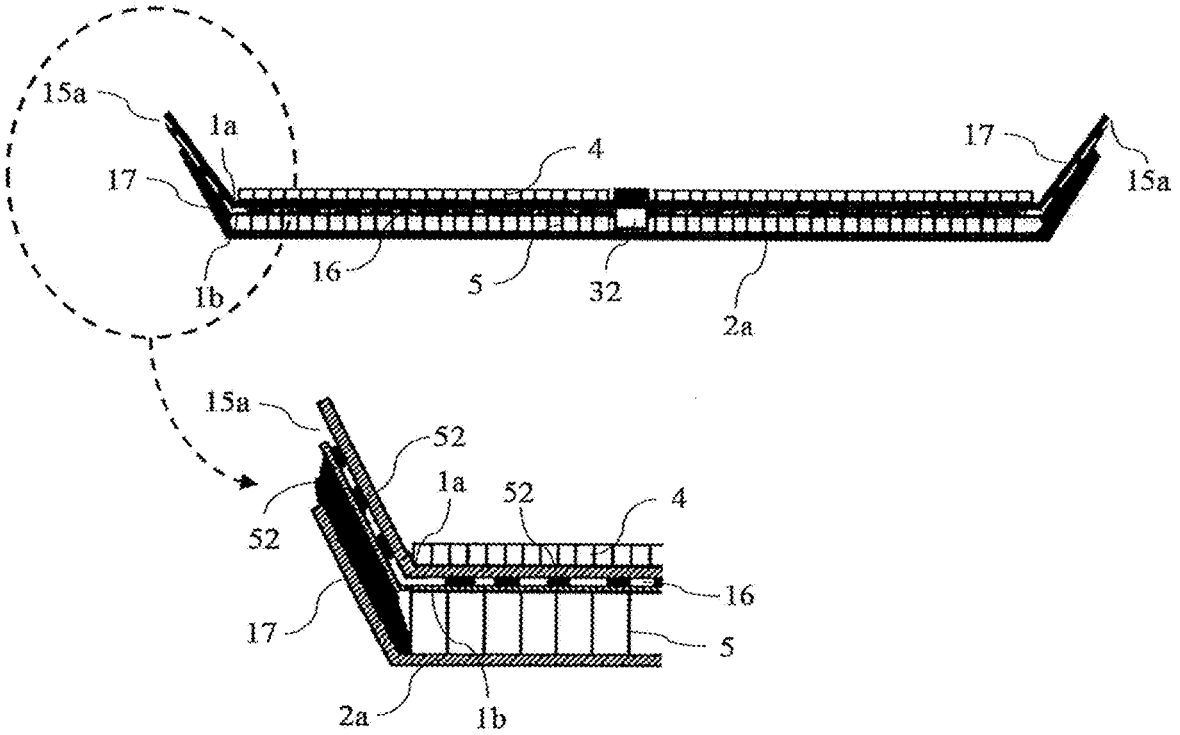
FIG. 22 is a sectional view of the heat transfer set included in the plate heat exchanger according to Embodiment 8 of the present disclosure taken along line B-B in FIG. 19.
Figure 23:
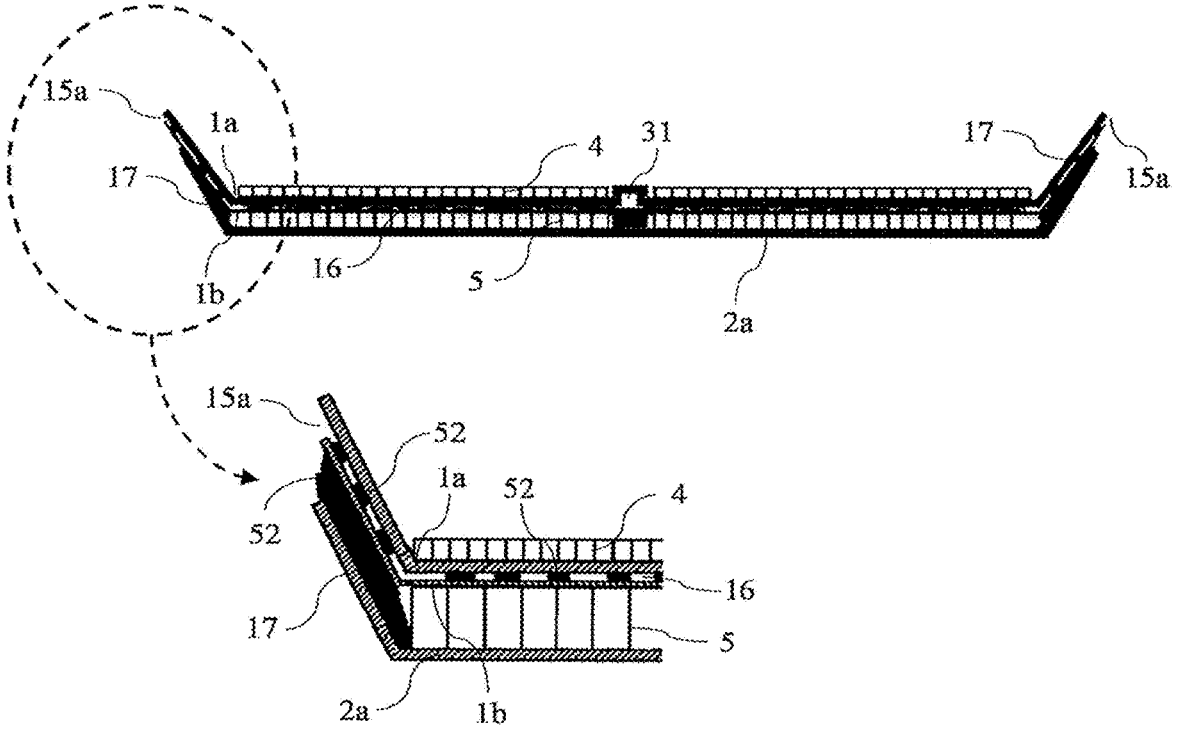
FIG. 23 is a sectional view of the heat transfer set included in the plate heat exchanger according to Embodiment 8 of the present disclosure taken along line C-C in FIG. 19.

FIG. 18 is an exploded side perspective view of a plate heat exchanger 100 according to Embodiment 8 of the present disclosure. FIG. 19 is a front perspective view of a heat transfer set 200 included in the plate heat exchanger 100 according to Embodiment 8 of the present disclosure. FIG. 20 is a front perspective view of a heat transfer plate 2 included in the plate heat exchanger 100 according to Embodiment 8 of the present disclosure. FIG. 21 is a sectional view of the heat transfer set 200 included in the plate heat exchanger 100 according to Embodiment 8 of the present disclosure taken along line A-A in FIG. 19. FIG. 22 is a sectional view of the heat transfer set 200 included in the plate heat exchanger 100 according to Embodiment 8 of the present disclosure taken along line B-B in FIG. 19. FIG. 23 is a sectional view of the heat transfer set 200 included in the plate heat exchanger 100 according to Embodiment 8 of the present disclosure taken along line C-C in FIG. 19.

As illustrated in FIGS. 18 to 23, the plate heat exchanger 100 according to Embodiment 8 is configured such that the pair of metal plates (1*a* and 1*b*) and 2*a* has partition passages 31 and 32 formed therebetween, the partition passages 31 and 32 extending in the longitudinal direction. The partition passages 31 and 32 are connected to the outside through the outer flow passages 15.

In the case where the wet spots 54 are provided, preferably, the partition passages 31 and 32 communicate with some of the wet spots 54 and are connected to the outside through the outer flow passages 15*b*.

As illustrated in FIGS. 21 to 23, the partition passage 31 and the partition passage 32 are formed by forming a projection on the metal plate 1*a* and a recess on the metal plate 1*b* and joining the metal plate 1*a* and the metal plate 1*b* together. As illustrated in FIG. 21, the partition passage 31 and the partition passage 32 communicate with each other.

Each first flow passage 6 is formed such that the projecting outer wall of the corresponding partition passage 31 (or the projection on the corresponding metal plate 1*a*) is brazed to the corresponding metal plate 2*a* to form a partition in the first flow passage 6. Each second flow passage 7 is formed such that the recessed outer wall of the corresponding partition passage 32 (or the recess on the corresponding metal plate 1*b*) is brazed to the corresponding metal plate 2*a* to form a partition in the second flow passage 7.

As illustrated in FIG. 19, a U-shaped flow can be formed in each first flow passage 6 due to the partition in the first flow passage 6. The U-shaped flow in the first flow passage 6 is such that the first fluid enters the first flow passage 6 through the opening 27 and flows toward the opening 29 through a flow passage formed between the partition in the first flow passage 6 and the outer wall portions 17 of the first flow passage 6. Then, the first fluid makes a U-turn through a flow passage around the opening 29 and the opening 30, flows toward the opening 28 through a flow passage formed between the partition in the first flow passage 6 and the outer wall portions 17 of the first flow passage 6, and is discharged through the opening 28.

As illustrated in FIG. 20, a U-shaped flow can be formed in each second flow passage 7 due to the partition in the second flow passage 7. The U-shaped flow in the second flow passage 7 is such that the second fluid enters the second flow passage 7 through the opening 29 and flows toward the opening 27 through a flow passage formed between the partition in the second flow passage 7 and the outer wall portions 17 of the second flow passage 7. Then, the second fluid makes a U-turn through a flow passage around the opening 27 and the opening 28, flows toward the opening 30 through a flow passage formed between the partition in the second flow passage 7 and the outer wall portions 17 of the second flow passage 7, and is discharged through the opening 30.

As described above, the partition passage 31 and the partition passage 32 communicate with each other and are connected to the wet spots 54 and the outer flow passages 15. Accordingly, when leakage of fluid occurs, the fluid flows through the fine flow passage 16 and then enters the partition passages 31 and 32, which have a height greater than that of the fine flow passage 16, from the fine flow passage 16 so that the fluid can be quickly discharged to the outside. Therefore, the fluid can be discharged at a flow rate sufficient to enable detection of the leakage, and time required to detect the leakage can be reduced. In addition, since the U-shaped flows along the in-plane flow passages can be realized due to the partition passages 31 and 32, the in-plane flow passage width can be significantly reduced, so that in-plane distribution among the in-plane flow passages can be improved. Accordingly, the heat exchange performance of the plate heat exchanger 100 can be increased.

Embodiment 9

Embodiment 9 of the present disclosure will now be described. Description given in Embodiments 1 to 8 will not be repeated, and components that are the same as or correspond to those in Embodiments 1 to 8 are denoted by the same reference signs.

Figure 24:
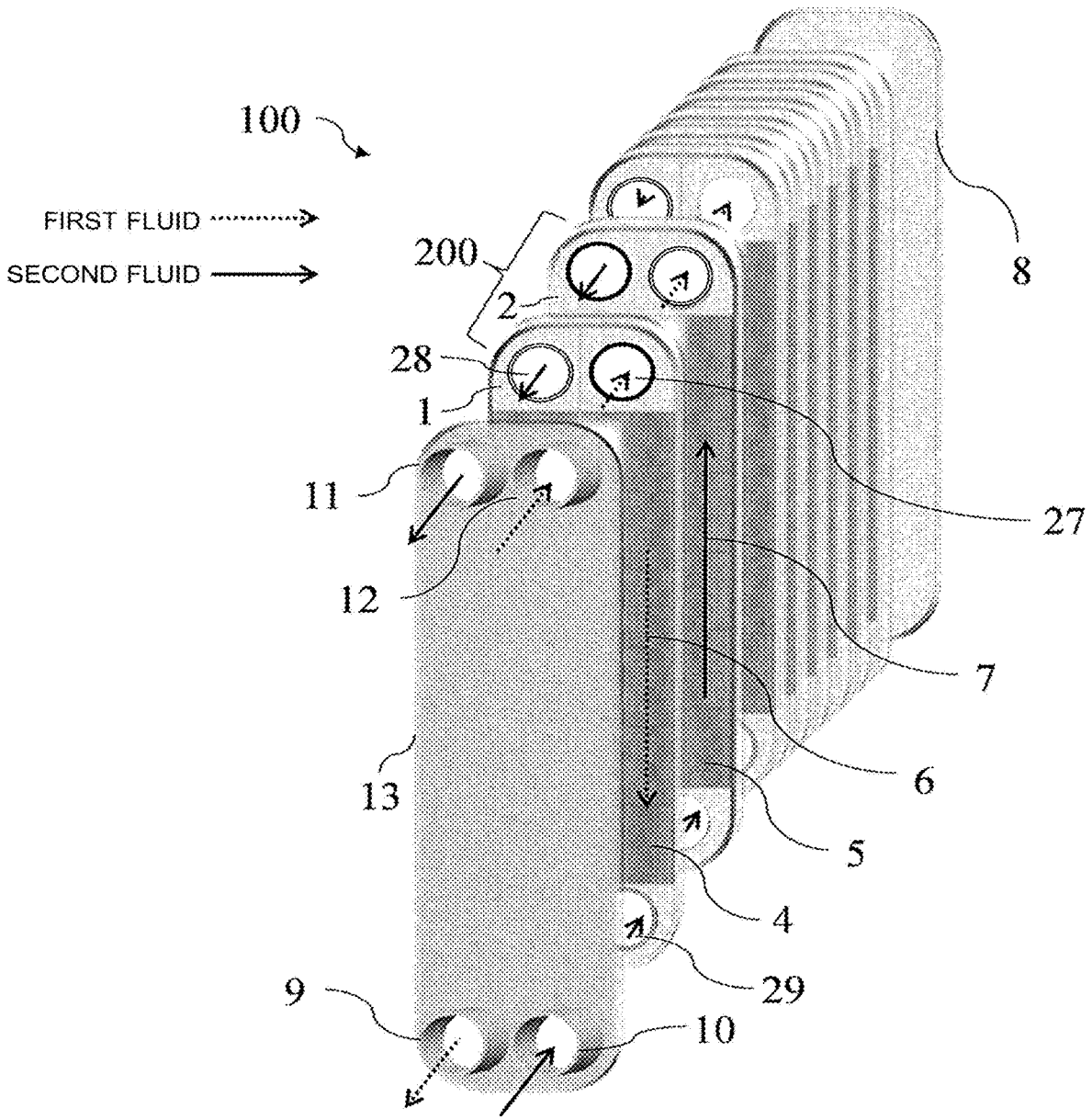
FIG. 24 is an exploded side perspective view of a plate heat exchanger according to Embodiment 9 of the present disclosure.
Figure 25:
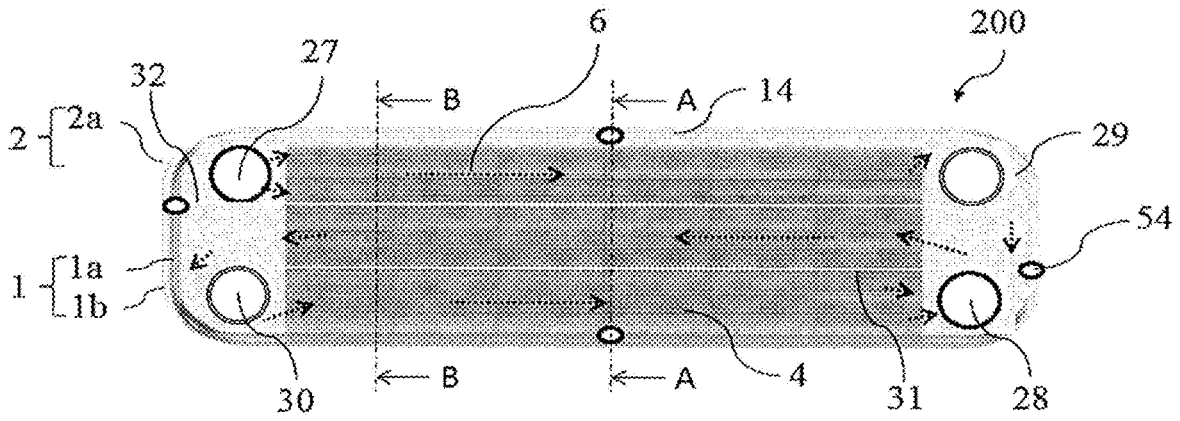
FIG. 25 is a front perspective view of a heat transfer set included in the plate heat exchanger according to Embodiment 9 of the present disclosure.
Figure 26:
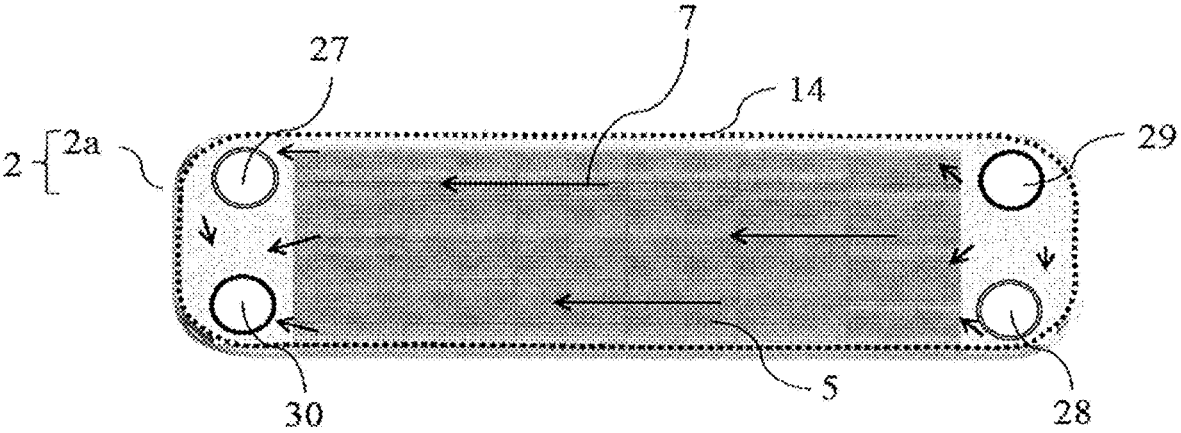
FIG. 26 is a front perspective view of a heat transfer plate included in the plate heat exchanger according to Embodiment 9 of the present disclosure.
Figure 27:
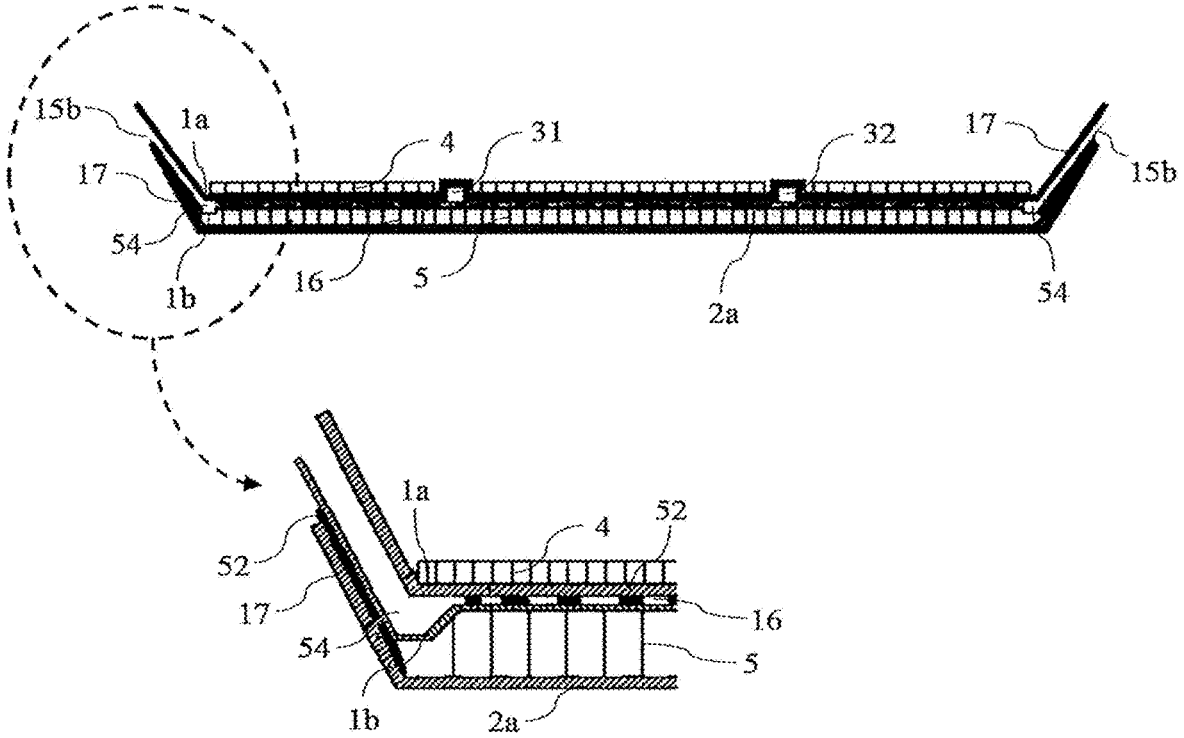
FIG. 27 is a sectional view of the heat transfer set included in the plate heat exchanger according to Embodiment 9 of the present disclosure taken along line A-A in FIG. 25.
Figure 28:
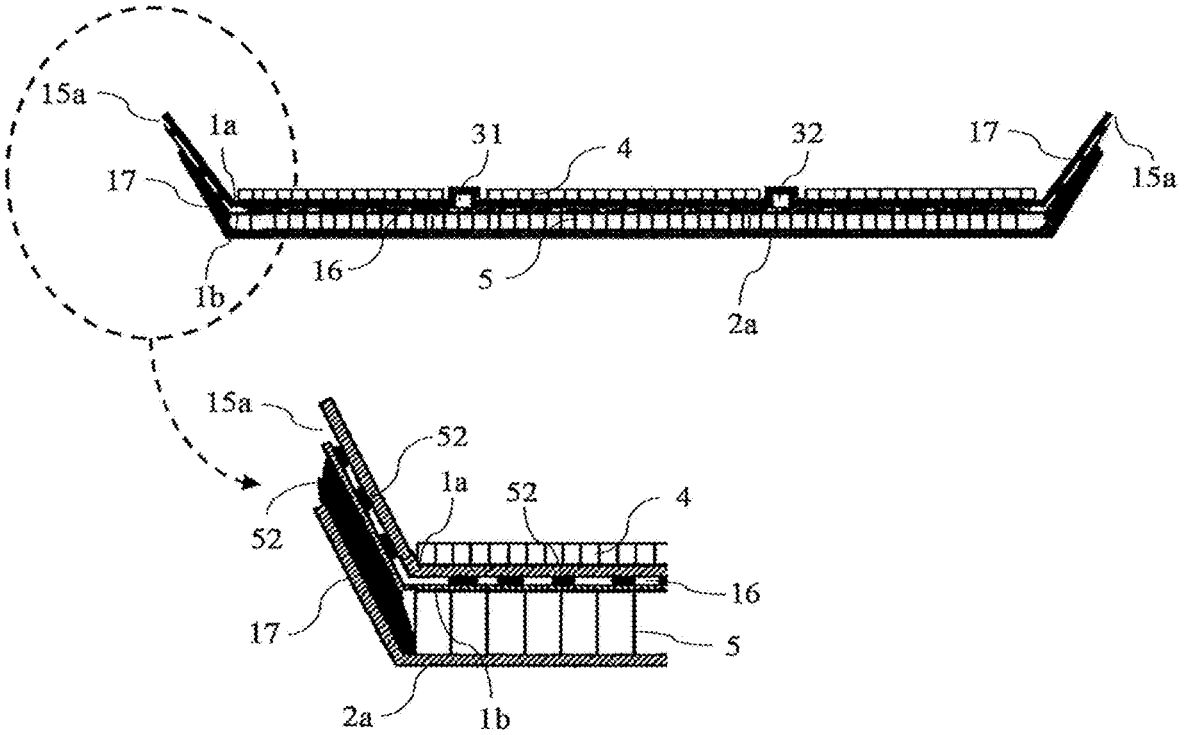
FIG. 28 is a sectional view of the heat transfer set included in the plate heat exchanger according to Embodiment 9 of the present disclosure taken along line B-B in FIG. 25.

FIG. 24 is an exploded side perspective view of a plate heat exchanger 100 according to Embodiment 9 of the present disclosure. FIG. 25 is a front perspective view of a heat transfer set 200 included in the plate heat exchanger 100 according to Embodiment 9 of the present disclosure. FIG. 26 is a front perspective view of a heat transfer plate 2 included in the plate heat exchanger 100 according to Embodiment 9 of the present disclosure. FIG. 27 is a sectional view of the heat transfer set 200 included in the plate heat exchanger 100 according to Embodiment 9 of the present disclosure taken along line A-A in FIG. 25. FIG. 28 is a sectional view of the heat transfer set 200 included in the plate heat exchanger 100 according to Embodiment 9 of the present disclosure taken along line B-B in FIG. 25.

As illustrated in FIGS. 24 to 28, the plate heat exchanger 100 according to Embodiment 9 is configured such that the pair of metal plates (1*a* and 1*b*) has partition passages 31 and 32 formed therebetween, the partition passages 31 and 32 extending in the longitudinal direction. Preferably, the partition passages 31 and 32 communicate with some of the wet spots 54 and are connected to the outside through the outer flow passages 15*b*.

Referring to FIGS. 24 to 28, the partition passages 31 and 32 are formed by forming projections on the metal plate 1*a* and joining the metal plate 1*a* and the metal plate 1*b* together.

Although the partition passages 31 and 32 are formed by forming projections on each metal plate 1*a* as illustrated in FIGS. 27 to 28, the partition passages 31 and 32 are not limited to this. For example, the partition passages 31 and 32 may instead be formed by forming a projection on each metal plate 1*a* and a recess on each metal plate 2*a*.

Each first flow passage 6 is formed such that the projecting outer wall of the corresponding partition passage 32 (or one projection on the corresponding metal plate 1*a*) is brazed to the corresponding metal plate 2*a* to form a first partition in the first flow passage 6. In addition, each first flow passage 6 is formed such that the projecting outer wall of the corresponding partition passage 31 (or the other projection on the corresponding metal plate 1*a*) is brazed to the corresponding metal plate 2*a* to form a second partition in the first flow passage 6. Each second flow passage 7 has no partitions.

As illustrated in FIG. 25, two U-shaped flows can be formed in each first flow passage 6 due to the partitions in the first flow passage 6. The two U-shaped flows in the first flow passage 6 are such that the first fluid enters the first flow passage 6 through the opening 27 and flows toward the opening 29 through a flow passage formed between the first partition in the first flow passage 6 and the outer wall portions 17 of the first flow passage 6. Then, the first fluid makes a first U-turn through a flow passage around the opening 29 and along the second partition, and flows toward the opening 30 through a flow passage formed between the first partition and the second partition. Then, the first fluid makes a second U-turn through a flow passage around the opening 30 and along the first partition, flows through a flow passage formed between the second partition in the first flow passage 6 and the outer wall portions 17 of the first flow passage 6, and is discharged through the opening 28.

As illustrated in FIG. 26, each second flow passage 7 has no partition. Therefore, the second fluid enters the second flow passage 7 through the opening 29, flows toward the opening 30 in a crossing manner through a flow passage formed between the outer wall portions 17 of the second flow passage 7, and is discharged through the opening 30.

As described above, the partition passages 31 and 32 are connected to the wet spots 54 and the outer flow passages 15. Accordingly, when leakage of fluid occurs, the fluid flows through the fine flow passage 16 and then enters the partition passages 31 and 32, which have a height greater than that of the fine flow passage 16, from the fine flow passage 16 so that the fluid can be quickly discharged to the outside. Therefore, the fluid can be discharged at a flow rate sufficient to enable detection of the leakage, and time required to detect the leakage can be reduced. In addition, since the two U-shaped flows along the in-plane flow passages can be realized due to the partition passages 31 and 32, the in-plane flow passage width can be significantly reduced, so that in-plane distribution among the in-plane flow passages can be improved. Accordingly, the heat exchange performance of the plate heat exchanger 100 can be increased.

Embodiment 10

Embodiment 10 of the present disclosure will now be described. Description given in Embodiments 1 to 9 will not be repeated, and components that are the same as or correspond to those in Embodiments 1 to 9 are denoted by the same reference signs.

Figure 29:
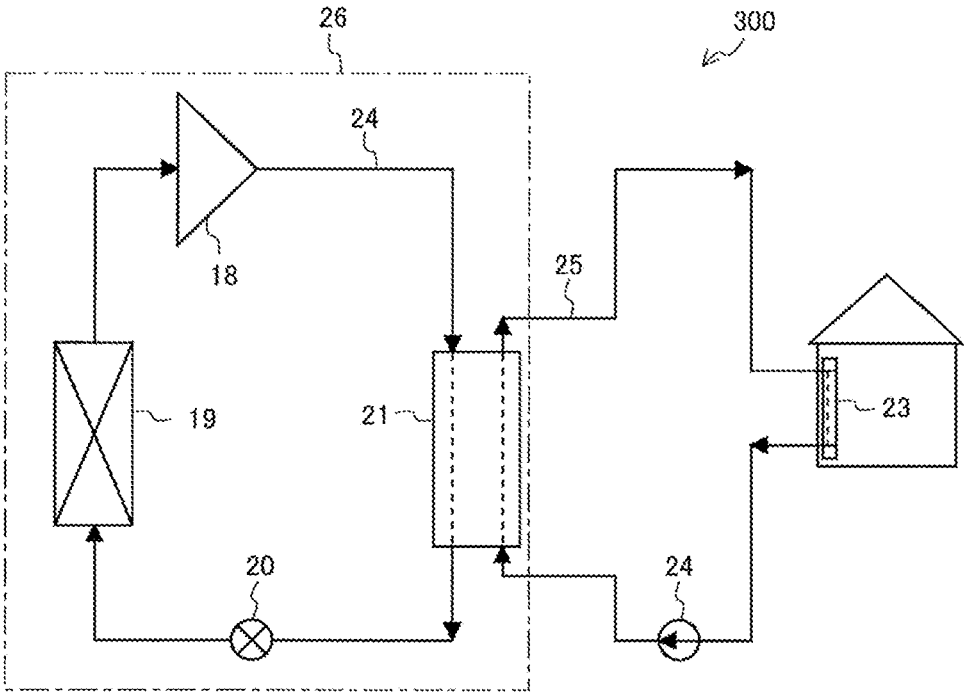
FIG. 29 is a schematic diagram illustrating the structure of a heat pump cooling, heating, and hot water supply system according to Embodiment 10 of the present disclosure.

FIG. 29 is a schematic diagram illustrating the structure of a heat pump cooling, heating, and hot water supply system 300 according to Embodiment 10 of the present disclosure.

The heat pump cooling, heating, and hot water supply system 300 according to Embodiment 10 includes a heat pump device 26 contained in a housing. The heat pump device 26 has a refrigerant circuit 24 and a heat medium circuit 25. The refrigerant circuit 24 is formed by successively connecting a compressor 18, a second heat exchanger 19, a pressure reducing device 20 composed of, for example, an expansion valve or a capillary tube, and a first heat exchanger 21 with pipes. The heat medium circuit 25 is formed by successively connecting the first heat exchanger 21, a cooling, heating, and hot water supply apparatus 23, and a pump 22 that circulates a heat medium with pipes.

The first heat exchanger 21 is the plate heat exchanger 100 described in any one of Embodiments 1 to 9, and performs heat exchange between refrigerant circulated in the refrigerant circuit 24 and the heat medium circulated in the heat medium circuit 25. The heat medium circulated in the heat medium circuit 25 may be any fluid capable of exchanging heat with the refrigerant in the refrigerant circuit 24, such as water, ethylene glycol, propylene glycol, or a mixture thereof.

The plate heat exchanger 100 is installed in the refrigerant circuit 24 such that the refrigerant flows through the first flow passages 6, whose heat transfer performance is higher than that of the second flow passages 7, and such that the heat medium flows through the second flow passages 7.

The plate heat exchanger 100 is configured such that the heat transfer plates 1 and 2 that separate the first flow passages 6 and the second flow passages 7 from each other have the outer flow passages 15 connected to the outside. Thus, the plate heat exchanger 100 installed in the refrigerant circuit 24 is configured such that even when, for example, corrosion of the first flow passages 6 or freezing of the second flow passages 7 occurs, the refrigerant that flows through the first flow passages 6 do not leak into the second flow passages 7.

The cooling, heating, and hot water supply apparatus 23 includes a hot water tank (not shown) and an indoor unit (not shown) that performs air conditioning of an indoor space. When the heat medium is water, water is caused to exchange heat with the refrigerant in the refrigerant circuit 24 and is thereby heated in the plate heat exchanger 100, and the heated water is stored in the hot water tank (not shown). The indoor unit (not shown) cools or heats the indoor space by guiding the heat medium in the heat medium circuit 25 into a heat exchanger included in the indoor unit and causing the heat medium to exchange heat with air in the indoor space. The structure of the cooling, heating, and hot water supply apparatus 23 is not limited to the above-described structure as long as cooling, heating, and hot water supply operations can be performed by using heating energy of the heat medium in the heat medium circuit 25.

As described above in Embodiments 1 to 9, the plate heat exchanger 100 has a high heat exchange efficiency, and flammable refrigerant (for example, R32, R290, or $HFO_{MIX}$) is usable therein. In addition, the plate heat exchanger 100 is strong and highly reliable. Accordingly, when the plate heat exchanger 100 is installed in the heat pump cooling, heating, and hot water supply system 300 according to Embodiment 10, an efficient heat pump cooling, heating, and hot water supply system 300 with reduced power consumption, improved safety features, and reduced $CO_2$ emission can be realized.

In Embodiment 10, the heat pump cooling, heating, and hot water supply system 300 that performs heat exchange between refrigerant and water is described as an example of a system to which the plate heat exchanger 100 according to any one of Embodiments 1 to 9 may be applied. However, the plate heat exchangers 100 described in Embodiments 1 to 9 are not necessarily applied to the heat pump cooling, heating, and hot water supply system 300, and may be applied to various industrial and domestic devices, such as a cooling chiller, a power generating apparatus, or a heat sterilization device for food.

As an exemplary application of the present disclosure, the plate heat exchangers 100 described in Embodiments 1 to 9 may be applied to a heat pump device 26 that is easy to manufacture and required to have an improved heat exchange performance and an improved energy saving performance.

REFERENCE SIGNS LIST

1 heat transfer plate 1*a* metal plate 1*b* metal plate 2 heat transfer plate 2*a* metal plate 2*b* metal plate 4 inner fin 5 inner fin 6 first flow passage 7 second flow passage 8 second reinforcing side plate 9 first outlet pipe 10 second inlet pipe 11 second outlet pipe 12 first inlet pipe 13 first reinforcing side plate 14 peripheral leakage passage 15 outer flow passage 15*a* outer flow passage 15*b* outer flow passage 16 fine flow passage 17 outer wall portion 18 compressor 19 second heat exchanger 20 pressure reducing device 21 first heat exchanger 22 pump 23 cooling, heating, and hot water supply apparatus 24 refrigerant circuit 25 heat medium circuit 26 heat pump device 27 opening 28 opening 29 opening 30 opening 31 partition passage 32 partition passage 40 first header 41 second header 52 brazed portion 54 wet spot 55 corrosion-resistant layer 100 plate heat exchanger 200 heat transfer set 300 heat pump cooling, heating, and hot water supply system

The invention claimed is:

1. A plate heat exchanger comprising:

a plurality of heat transfer plates which each have openings at four corners thereof, the plurality of heat transfer plates being stacked together, wherein the plurality of heat transfer plates are partially brazed together such that a first flow passage through which first fluid flows and a second flow passage through which second fluid flows are alternately arranged with one of the plurality of heat transfer plates disposed therebetween, the openings at the four corners being connected to each other to form first headers through which the first fluid enters and is discharged and second headers through which the second fluid enters and is discharged, wherein at least one of the plurality of heat transfer plates between which the first flow passage or the second flow passage is disposed is formed by a pair of metal plates that are stacked together, and wherein, the pair of metal plates includes a first plate that is adjacent to the second flow passage and that is thinner than a second plate in the pair of metal plates that is adjacent to the first flow passage, each of the pair of metal plates that are stacked together includes a flat heat exchange region, a third flow passage is formed by placing a brazed portion having a height in a stacking direction between flat surfaces of the pair of metal plates in the flat heat exchange region, a first pair of the openings are arranged at a first end of the heat transfer plates in a longest dimension of the plurality of heat transfer plates, a second pair of the openings are arranged at a second end of the heat transfer plates in the longest dimension of the plurality of heat transfer plates, and the flat heat exchange region is arranged entirely between the first pair of the openings and the second pair of the openings in the longest dimension of the plurality of heat transfer plates.

2. The plate heat exchanger of claim 1, wherein one of the plurality of heat transfer plates between which the first flow passage or the second flow passage is disposed is formed by a single metal plate.

3. The plate heat exchanger of claim 1, wherein the first flow passage and the second flow passage are provided with inner fins.

4. The plate heat exchanger of claim 1, wherein a space between the pair of metal plates includes a fine flow passage formed in a heat exchange region in which the first fluid and the second fluid exchange heat, and a peripheral leakage passage formed in a region outside the fine flow passage, the peripheral leakage passage communicating with an outside.

5. The plate heat exchanger of claim 3, wherein the inner fins are made of a different material than at least one of the heat transfer plates.

6. The plate heat exchanger of claim 4, wherein an outer flow passage that is connected to the outside is provided in a region outside the peripheral leakage passage.

7. The plate heat exchanger of claim 1, wherein outer wall portions are provided at edges, and wherein the outer wall portions are not brazed together.

8. The plate heat exchanger of claim 1, wherein corrosion-resistant layers are provided on metal plates between which the second flow passage is disposed.

9. A heat pump device comprising:

a refrigerant circuit in which refrigerant is circulated, the refrigerant circuit including a compressor, a heat exchanger, a pressure reducing device, and the plate heat exchanger of claim 1 that are connected to each other; and a heat medium circuit in which a heat medium is circulated, the heat medium exchanging heat with the refrigerant in the plate heat exchanger.

10. A heat pump heating and hot water supply system comprising the heat pump device of claim 9, a heating and hot water supply apparatus that performs heating and hot water supply operations by using heating energy of the heat medium, and a pump that is provided in the heat medium circuit and that circulates the heat medium.

11. The plate heat exchanger of claim 1, wherein the third flow passage is formed over an entirety of the flat heat exchange region.

* * * * *